US012195960B2

(12) United States Patent
Allen et al.

(10) Patent No.: US 12,195,960 B2
(45) Date of Patent: Jan. 14, 2025

(54) PANEL ASSEMBLY AND ACCESSORIES AND METHOD FOR THE USE AND ASSEMBLY THEREOF

(71) Applicant: Steelcase Inc., Grand Rapids, MI (US)

(72) Inventors: John Mark Allen, Grand Rapids, MI (US); William B. Bennie, Rockford, MI (US); Brian Bultsma, Byron Center, MI (US); Rachel L. Dekker, Grandville, MI (US); Michael John Feldpausch, Middleville, MI (US); Anbazhagan Gandhi, Byron Center, MI (US); James D. Houda, Byron Center, MI (US); Trevor A. Knauf, Ada, MI (US)

(73) Assignee: STEELCASE INC., Grand Rapids, MI (US)

( * ) Notice: Subject to any disclaimer, the term of this patent is extended or adjusted under 35 U.S.C. 154(b) by 302 days.

(21) Appl. No.: 17/944,420

(22) Filed: Sep. 14, 2022

(65) Prior Publication Data

US 2023/0086481 A1 Mar. 23, 2023

Related U.S. Application Data

(60) Provisional application No. 63/247,141, filed on Sep. 22, 2021.

(51) Int. Cl.
*E04B 2/74* (2006.01)

(52) U.S. Cl.
CPC ..... *E04B 2/7405* (2013.01); *E04B 2/7433* (2013.01); *E04B 2002/7461* (2013.01)

(58) Field of Classification Search
CPC ..... E04B 2/7405; E04B 2/7433; E04B 2002/7461; E04B 2002/7466; E04B 1/8227; E04B 1/8236; E04B 2/7416; E04B 2/72
See application file for complete search history.

(56) References Cited

U.S. PATENT DOCUMENTS 365,356 A 6/1887 Travis
402,570 A 5/1889 Davis
(Continued)

FOREIGN PATENT DOCUMENTS

CH 637 885 A 8/1983
CN 20021161 U1 3/2001
(Continued)

OTHER PUBLICATIONS

International Search Report and Written Opinion for corresponding International Application No. PCT/US2022/042747 mailed Jan. 31, 2023 (15 pages).
(Continued)

*Primary Examiner* — Patrick J Maestri
(74) *Attorney, Agent, or Firm* — Crowell & Moring LLC

(57) ABSTRACT

A panel assembly includes a vertical panel, an overhang panel and a curved transition panel disposed between the vertical panel and the overhang panel. A fabric layer may be applied to one or more of the various panels by way of a stay being engaged with fabric layer and inserted through an opening in the one or panels. A light assembly may be secured to the panel assembly with a mounting portion. A hook assembly includes vertical and horizontal flanges, with a magnet coupled to the horizontal flange and a hook connected to the vertical flange.

21 Claims, 20 Drawing Sheets

(56) References Cited

U.S. PATENT DOCUMENTS 1,931,534 A 10/1933 Friedman
2,248,884 A 7/1941 McAdams
2,436,533 A 7/1946 Thompson
2,507,559 A 5/1950 D'Andrea
2,605,906 A 8/1952 Pontius
2,648,863 A 8/1953 Darling
2,689,966 A 9/1954 Reuss
2,954,954 A 9/1958 Larson
3,841,704 A 10/1974 Platner
3,875,711 A 4/1975 Palmer
4,097,918 A 6/1978 Anderson et al.
4,250,676 A 2/1981 Presby
4,351,017 A 9/1982 Ball
4,516,620 A 5/1985 Mulhern
4,588,626 A 5/1986 Cologna et al.
4,602,817 A 7/1986 Raftery
4,698,871 A 10/1987 Patkos
4,715,154 A 12/1987 Baloga
4,830,322 A 5/1989 Gary
4,879,436 A 11/1989 Braham
4,890,883 A 1/1990 Boerema et al.
4,987,634 A 1/1991 Weihrauch
5,040,104 A 8/1991 Huisingh et al.
5,069,011 A * 12/1991 Jenne ..... G10K 11/20 52/73
5,238,515 A 8/1993 Insalaco et al.
5,413,297 A 5/1995 Adams
5,542,352 A 8/1996 Blackman et al.
5,646,378 A * 7/1997 Van Haaff ..... H04R 5/02 181/144
5,900,303 A 5/1999 Billarant
5,908,002 A 6/1999 Alexander et al.
5,941,713 A 8/1999 Wayner et al.
6,085,861 A * 7/2000 Jines ..... E04B 1/8236 52/6
6,224,030 B1 5/2001 Hepworth
6,237,668 B1 * 5/2001 Hitchings ..... A47G 5/00 160/351
6,263,817 B1 7/2001 Tajima et al.
6,311,441 B1 11/2001 Beavers et al.
6,491,271 B1 12/2002 Adams
6,565,049 B2 5/2003 Hahn
6,672,551 B2 1/2004 Rivellino et al.
6,748,710 B2 6/2004 Gresham et al.
6,793,430 B1 9/2004 Liu
6,807,776 B2 10/2004 Girdwood et al.
6,814,335 B2 11/2004 Immerman
6,848,744 B1 2/2005 Raftery et al.
6,854,610 B2 2/2005 Adams
7,154,363 B2 12/2006 Hunts
7,209,021 B2 4/2007 Clement
7,313,841 B2 1/2008 Huang
7,600,608 B2 * 10/2009 Freiheit ..... E04B 1/8236 181/287
7,891,616 B2 2/2011 Pinchuk et al.
7,967,520 B2 6/2011 Hawkins
8,091,605 B1 * 1/2012 Melhart ..... A47G 5/00 160/351
8,430,199 B2 * 4/2013 Stephenson ..... E04H 3/24 181/287
D683,150 S 5/2013 Smith et al.
8,458,863 B2 6/2013 Hunts
8,528,149 B2 9/2013 Statkus
9,002,169 B2 4/2015 Huang
9,320,409 B1 4/2016 Lu et al.
9,339,137 B2 5/2016 Nelson
9,642,480 B1 5/2017 Tanger et al.
9,809,049 B2 11/2017 Franco
9,856,643 B1 * 1/2018 Lytle ..... E04B 2/7405
10,190,762 B2 1/2019 Dau et al.
10,228,000 B2 3/2019 Tirrell et al.
10,330,134 B2 6/2019 Danko
10,589,657 B1 3/2020 Etzkorn
10,736,273 B1 8/2020 Kacines
10,933,783 B1 3/2021 Hamlin
2002/0074845 A1 6/2002 Perske et al.
2003/0001421 A1 1/2003 Schmidt
2003/0042773 A1 3/2003 Stiller et al.
2003/0051415 A1 3/2003 Remelts et al.
2003/0162008 A1 8/2003 Cappucci et al.
2003/0182871 A1 10/2003 Gresham et al.
2003/0182885 A1 10/2003 Gresham et al.
2003/0215601 A1 11/2003 Pedde et al.
2004/0016519 A1 1/2004 Welfonder
2004/0061254 A1 4/2004 Snooks
2004/0124689 A1 7/2004 Numa et al.
2004/0217677 A1 11/2004 Durand et al.
2005/0006944 A1 1/2005 Ali et al.
2005/0202714 A1 9/2005 Strayer
2006/0000043 A1 1/2006 Jou-Chen et al.
2006/0060420 A1 * 3/2006 Freiheit ..... E04B 1/8236 181/287
2006/0174562 A1 8/2006 Insalaco
2006/0198117 A1 9/2006 Fong
2007/0257531 A1 11/2007 Mashimo
2007/0261315 A1 11/2007 Ludwig et al.
2009/0064471 A1 3/2009 Santin et al.
2009/0100654 A1 4/2009 Carps
2010/0117434 A1 5/2010 Galbreath et al.
2010/0163696 A1 7/2010 Briggs et al.
2011/0010903 A1 1/2011 Starbuck
2011/0026255 A1 2/2011 Kwak
2011/0227390 A1 9/2011 Lovasz
2011/0239908 A1 10/2011 Nakamura et al.
2011/0267797 A1 11/2011 Clark et al.
2011/0304183 A1 12/2011 van Hekken
2013/0167313 A1 7/2013 McKenzie
2013/0256472 A1 10/2013 Liu et al.
2013/0263769 A1 10/2013 Tempestra
2013/0314852 A1 11/2013 Kincaid et al.
2014/0115985 A1 5/2014 Hayashi
2014/0285473 A1 9/2014 Chang
2014/0306082 A1 10/2014 Harvala
2014/0311036 A1 10/2014 Alexander et al.
2014/0362602 A1 12/2014 Hofman
2015/0121772 A1 * 5/2015 Berken ..... E04B 2/7405 52/28
2015/0247633 A1 9/2015 Dau et al.
2016/0245005 A1 8/2016 Tshchiyama et al.
2016/0369981 A1 12/2016 Emde et al.
2017/0282769 A1 10/2017 Stephan
2017/0328127 A1 11/2017 Stathis
2018/0056710 A1 3/2018 Boettcher et al.
2018/0295982 A1 10/2018 Yamamoto
2018/0363889 A1 12/2018 Yen et al.
2020/0062582 A1 2/2020 Smith et al.
2021/0017762 A1 * 1/2021 Fleisch ..... E04B 1/3211
2021/0071417 A1 3/2021 Deleu

FOREIGN PATENT DOCUMENTS

CN 201328646 Y 10/2009
CN 202727766 U 2/2013
CN 202945704 5/2013
CN 103807508 A 5/2014
CN 2015-37471 2/2015
CN 105762727 A 7/2016
CN 205822510 U 12/2016
CN 106300162 A 1/2017
CN 108649508 A 10/2018
CN 208209470 U 12/2018
CN 209045782 U 6/2019
CN 209642253 U 11/2019
DE 42 19 943 C1 2/1993
DE 202013009671 1/2014
DE 10 2012 023 773 A1 6/2014
DE 201710126920 A1 6/2019
EP 1543993 A1 6/2005
GB 302776 12/1928
GB 446471 4/1936
GB 2 184 648 A1 7/1987
GB 2 370 983 A 7/2002
GB 2461039 A 12/2009

(56) References Cited

FOREIGN PATENT DOCUMENTS

| | | | |
|---|---|---|---|
| JP | 53063598 | U | 5/1978 |
| JP | H 03161565 | A | 7/1991 |
| JP | 11-78383 | | 3/1999 |
| JP | 2010187712 | A | 9/2010 |
| JP | 2017086373 | A | 5/2017 |
| KR | 19980042382 | U | 9/1998 |
| KR | 19980062596 | U | 11/1998 |
| KR | 20030094840 | A | 12/2003 |
| KR | 20090002574 | | 3/2009 |
| KR | 100946430 | B1 | 3/2010 |
| KR | 10-0977389 | B1 | 8/2010 |
| KR | 20110001082 | U | 2/2011 |
| KR | 20110038364 | A | 4/2011 |
| KR | 20170065113 | A | 6/2017 |
| TW | M241253 | U | 8/2004 |
| TW | M346362 | U | 12/2008 |
| WO | WO 93/15919 | | 8/1993 |
| WO | WO03035991 | A2 | 5/2003 |
| WO | WO2004066464 | | 8/2004 |
| WO | WO 2004/074566 | A1 | 9/2004 |
| WO | WO 2007/037587 | A1 | 4/2007 |
| WO | WO2018189333 | A1 | 10/2018 |
| WO | WO19179013 | A1 | 9/2019 |

OTHER PUBLICATIONS

Mavoro, Mavoro Strong Magnetic Hooks for Hanging Coats and Bags. Set of 2 Black Magnet Hooks Heavy Duty Magnets, Neodymium 52 Rare Earth Magnets. Push Pin Style Magnet Hook for Refrigerator, Locker etc, Aug. 11, 2021, https://www.amazon.in/Mavoro-Magnetic-Neodumiurn-Magnets-Refrigerator/dp/B07GKO7R7S (4 pages).

* cited by examiner

PANEL ASSEMBLY AND ACCESSORIES AND METHOD FOR THE USE AND ASSEMBLY THEREOF

This application claims the benefit of U.S. Provisional Application No. 63/247,141 filed Sep. 22, 2021, the entire disclosure of which is hereby incorporated herein by reference.

FIELD OF THE INVENTION

The present application relates generally to a panel assembly, for example a panel assembly having a fabric layer, together with accessories for use with a panel assembly and methods for the use and assembly of the panel assembly and accessories.

BACKGROUND

Panels, including for example privacy screens, are commonly used in various office environments to define workspaces. The panels may be freestanding or supported by an adjacent structure, such as a table or desk. Typically, such panels are planar, or run in a single horizontal direction and have a vertical orientation. As such, the panels are not well suited to contain air flow or contaminants dispersed adjacent, or emanating from, one side of the panel. As such, workers or individuals on one side of the panel may be exposed to the air flow and/or contaminants emanating from the other side of the panel.

In addition, workspaces may be configured in an open environment, or may be used for hoteling, wherein different workers use the same workspace. In such environments, it may be desirable to provide storage for various accessories, such as bags or backpacks. Typically, however, such spaces are not configured with such storage, or the storage is permanently fixed to the panel, thereby making reconfiguration difficult.

SUMMARY

The present invention is defined by the following claims, and nothing in this section should be considered to be a limitation on those claims.

In one aspect, one embodiment of a panel assembly includes a vertical panel having opposite front and rear surfaces, an upper portion and a bottom portion. The panel assembly includes an overhang panel having opposite upper and lower surfaces, an inner portion and an outer portion, wherein the overhang panel extends upwardly and outwardly from the upper portion of the vertical panel. A curved transition panel is disposed between the upper portion of the vertical panel and the inner portion of the overhang panel, wherein the transition panel includes a rear surface and a front concave surface disposed between the front surface of the vertical panel and the lower surface of the overhang panel. The outer portion of the overhang panel is laterally spaced from the vertical panel. In one embodiment, the panel assembly includes a second vertical panel and a second overhang panel with curved transition panels extending between the vertical panels and between the overhang panels.

In another aspect, one embodiment of a panel assembly includes a panel having opposite first and second sides and at least one opening extending between the first and second sides. A fabric layer covers at least a portion of the first side of the panel. The fabric layer has a first surface facing toward the first side of the panel and a second surface facing away from the first side of the panel. A stay is engaged with the second surface of the fabric layer, wherein the stay and a portion of the fabric layer are inserted through the opening and disposed on the second side of the panel.

In another aspect, one embodiment of a panel assembly includes a frame having or defining an edge with a first portion having a first cross-sectional thickness defined by a first outermost exterior surface and a second portion having a second cross-sectional thickness defined by a second outermost exterior surface, wherein the first cross-sectional thickness is greater than the second cross-sectional thickness. A fabric layer at least partially surrounds the first and second portions of the edge. A light assembly includes a mounting portion surrounding at least a portion of the second portion of the edge, wherein the fabric layer is disposed between the second portion and the mounting portion. In one embodiment, at least a portion of an exterior surface of the mounting portion is substantially flush with an outer surface of the fabric layer covering the first portion of the edge at the junction of those surfaces. In one embodiment, the edge may be defined by a frame including a rod, for example a tubular member.

In another aspect, one embodiment of a hook assembly includes a vertical flange having a first side and a second side and a horizontal flange connected to the vertical flange and extending laterally in a first direction from the first side of the vertical flange. A magnet is coupled to a bottom surface of the horizontal flange. A hook is connected to the vertical flange and extends laterally from the second side of the vertical flange in a second direction opposite the first direction.

Various methods of using and assembling the panel assembly and hook assembly are also provided.

The various embodiments of the panel assembly, and methods for the use and assembly thereof, provide significant advantages over other panel assemblies and methods. For example and without limitation, the curved configuration of the transition portions of the panel assembly, in combination with the vertical portions and overhang portions, provides a containment space that isolates the user, and in particular the air flow and/or ambient air in the space, from other workers or individuals positioned outside the space and in particular on the other side of the panel assembly. Other aspects facilitate the construction of the panel assembly, including for example a fabric attachment system that conforms a fabric to a curved surface without the need for adhesives or other unsightly fasteners. Likewise, the panel system may be provided with a light assembly that may be seamlessly, and removably, integrated into the fabric covered panel, while providing lighting to the containment space, including back lighting to the panel and/or downlighting to an adjacent worksurface under the overhang.

Embodiments of the hook assembly, and methods for the use thereof, also provide significant advantages over other hook assemblies. The hook assembly may be quickly and easily secured to a supporting structure, such as a wall panel, simply by magnetically engaging the magnet with an underlying support structure, such as a ferromagnetic material (e.g., metal). The horizontal flange may carry a substantial vertical load, while the non-skid pad and vertical flange resist any horizontal shear and/or any moment created by a load applied to the hook. The hook may be easily disengaged from the support structure and relocated as desired to another location.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
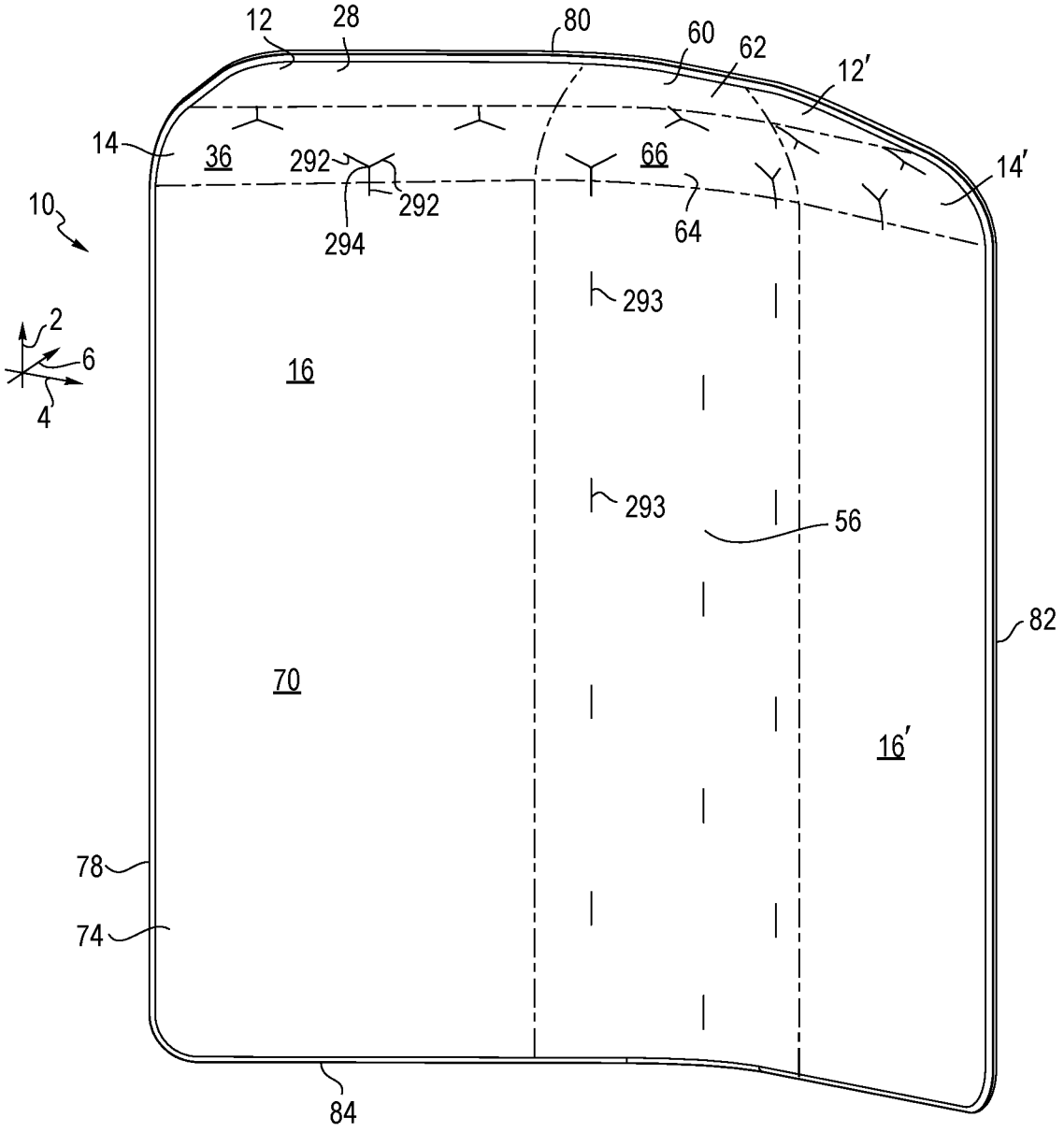
FIG. 1 is a front perspective view of one embodiment of a panel assembly.

It should be understood that the term "plurality," as used herein, means two or more. The term "longitudinal," as used herein means of or relating to a length or lengthwise direction, for example a direction running from the bottom of a panel assembly 10 to the top thereof, or vice versa. The term "lateral," as used herein, means situated on, directed toward or running in a side-to-side direction 4, or front-to-back 6 direction, of a panel assembly. In this way, the term longitudinal refers to a Y axis or direction 2, while the term lateral refers to the X and Z axes or directions 4, 6.

The term "coupled" means connected to or engaged with, whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of an exemplary panel assembly 10. The term "transverse" means non-parallel. The term "outwardly" refers to a direction facing away from a reference location, for example the phrase "laterally outwardly" refers to a feature diverging away from a reference location, for example a surface of a panel. Conversely, the term "inwardly" refers to a direction facing toward the reference location.

Panel Assembly:

Referring to FIGS. 1-3C, one embodiment of a panel assembly 10 includes a vertical panel 16, an overhang panel 12 and a curved transition panel 14 disposed between the vertical panel and the overhang panel. The vertical panel 16 may include opposite front and rear surfaces 18, 20, an upper portion 22 and a bottom portion 24. The overhang panel 12 may include opposite upper and lower surfaces 26, 28, an inner portion 30 and an outer portion 32. The overhang panel 12 extends upwardly and outwardly from the upper portion 22 of the vertical panel. The curved transition panel 14 includes a rear surface 34, which may be convex, and a front concave surface 36 disposed between the front surface 18 of the vertical panel and the lower surface 28 of the overhang panel. The concave surface 28 curves generally about a horizontal axis, which may be linear or curved (e.g., where overhang has compound curvature). The outer portion 32 of the overhang panel, defined in one embodiment as an edge or edge portion, is laterally spaced from the vertical panel 16, for example in the Z direction 6, and also longitudinally spaced from the vertical panel in the Y direction 2. As shown in the embodiments of FIGS. 3A and B, the panel assembly 10 may be configured for mounting to a desk or table. The panel assembly 10 may include a plurality of mounting brackets 38 having a vertical flange 40 mounted to the vertical panel 16, for example with mechanical fasteners, tabs and/or welding, and a horizontal flange 42 extending laterally from the vertical flange, for example in the Z direction 6. The horizontal flange 42 may be secured to an underside of a worksurface 50, for example with fasteners. In other embodiments, shown for example in FIGS. 2A and 3C, the panel assembly 10 is free standing, meaning the panel assembly may be self-supported on a floor, for example on glides 23 disposed along a bottom of the panel, although the panel assembly may alternatively also be secured to an adjacent support structure, such as a desk, cabinet or frame.

Figure 2A:
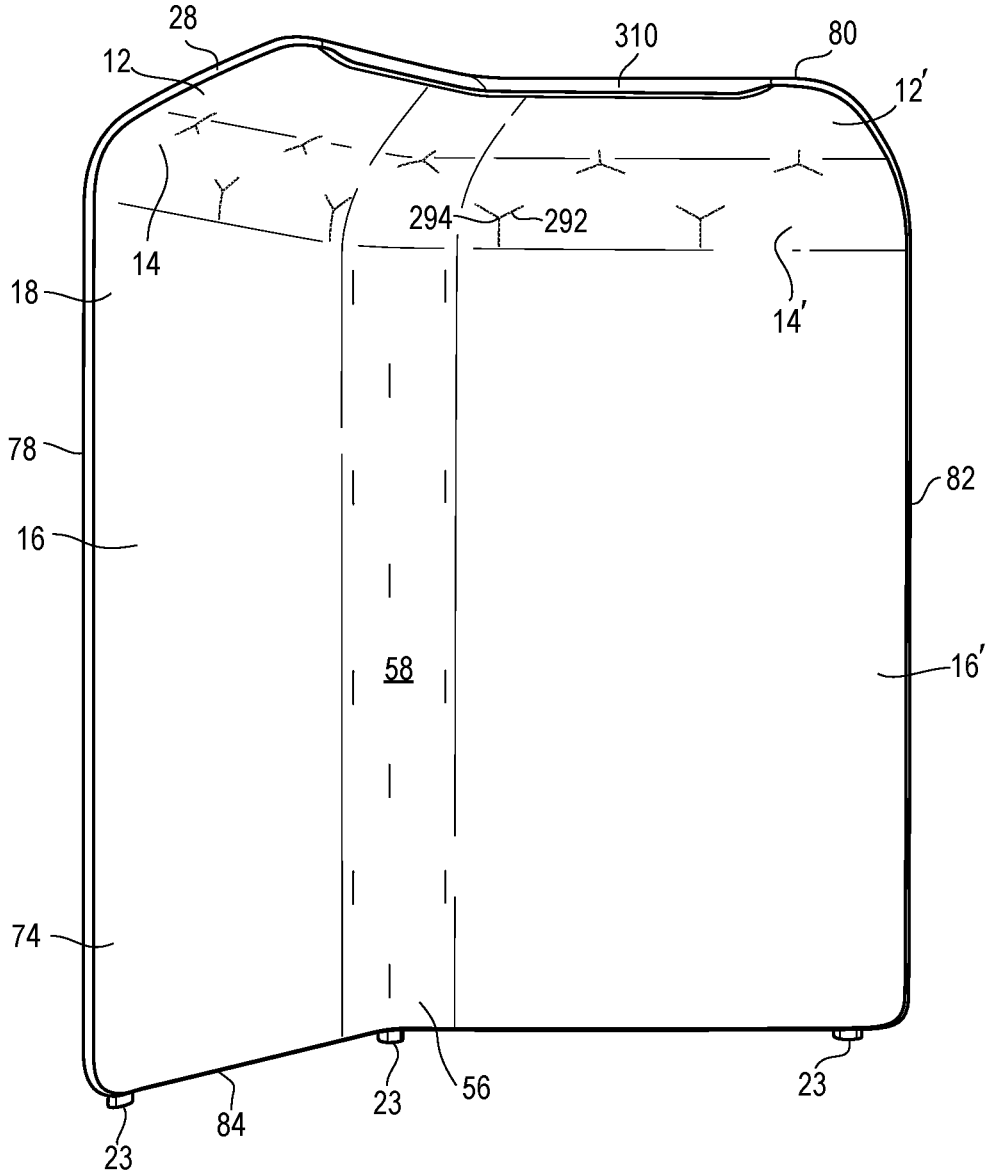
FIG. 2A is front perspective view of another embodiment of a panel assembly.
Figure 2B:
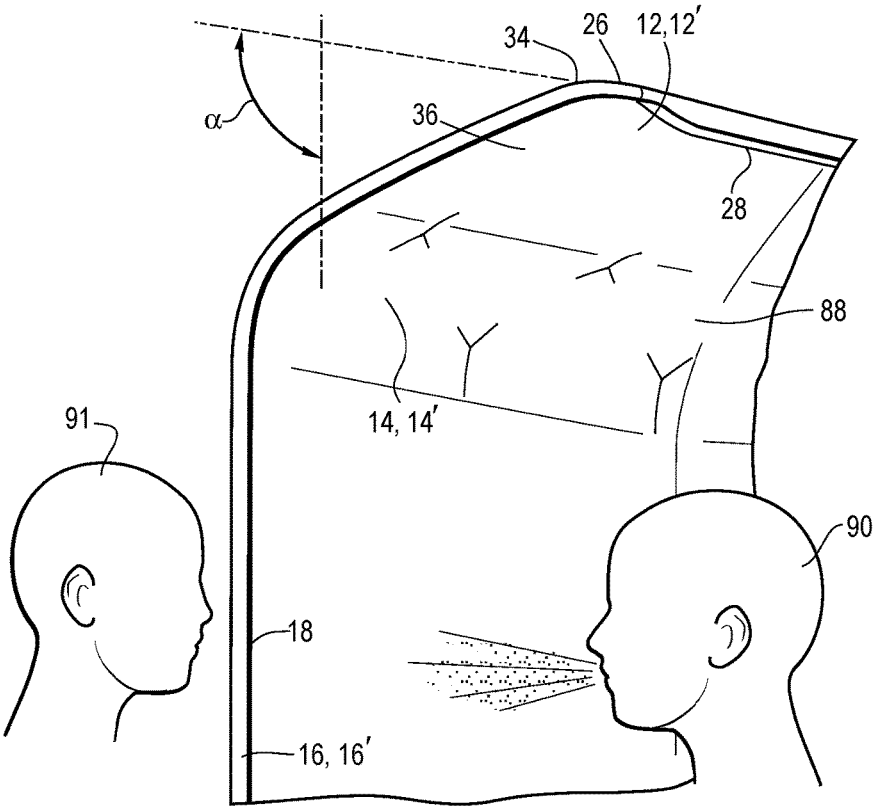
FIG. 2B is a partial, schematic cross-sectional view of the panel assembly shown in FIG. 2A and taken along the Y-Z plane.

In one embodiment, the lower surface 28 of the overhang panel defines a first planar portion and the front surface 18 of the vertical panel defines a second planar portion, wherein the first and second planar portions form an angle $\alpha$ of between and including 30 degrees and 90 degrees as shown in FIG. 2B, and in one embodiment between 50 and 80 degrees. In one embodiment, the angle $\alpha$ may be about 65 degrees.

Figure 2C:
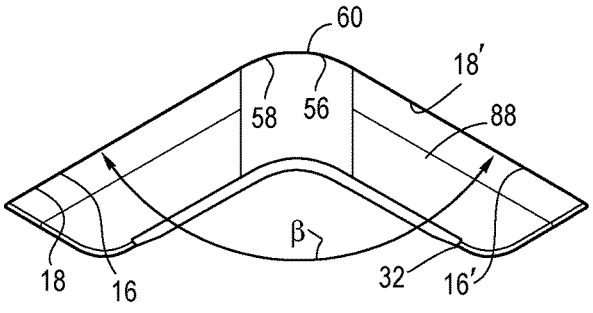
FIG. 2C is a partial, schematic cross-sectional view of the panel assembly shown in FIGS. 2A, 3B and 3C and taken along the X-Z plane.
Figure 2D:
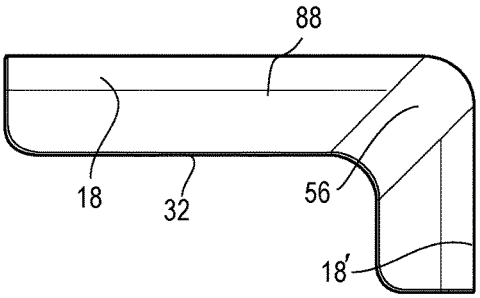
FIG. 2D is a partial, schematic cross-sectional view of the panel assembly shown in FIG. 3A and taken along the X-Z plane.
Figure 3A:
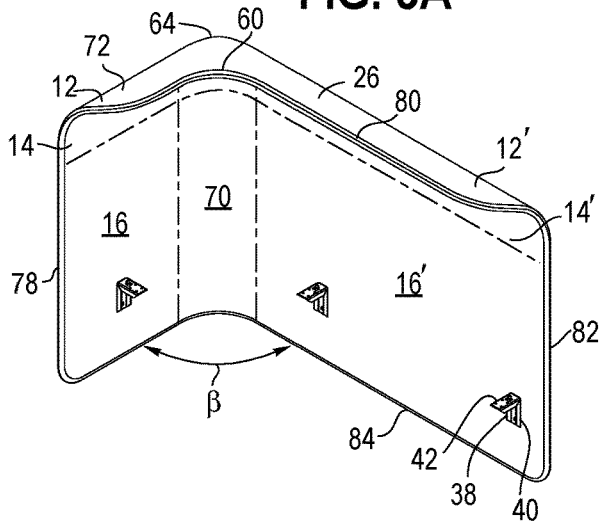
FIGS. 3A-C are front perspective views of other embodiments of panel assemblies.
Figure 3B:
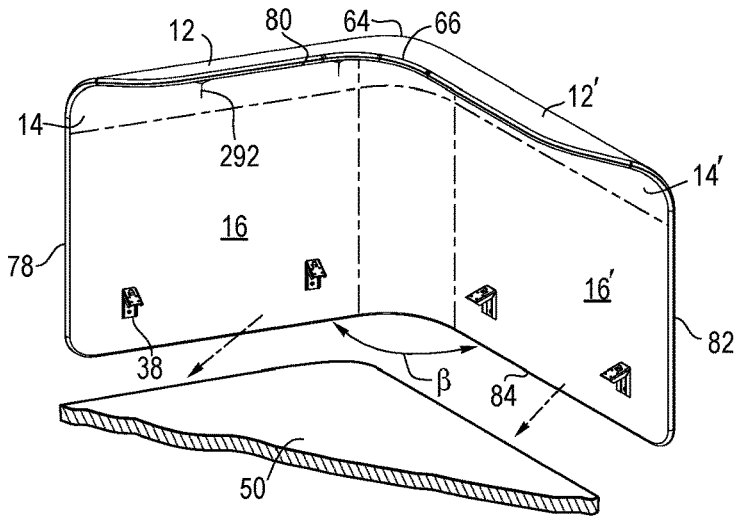
Figure 3C:
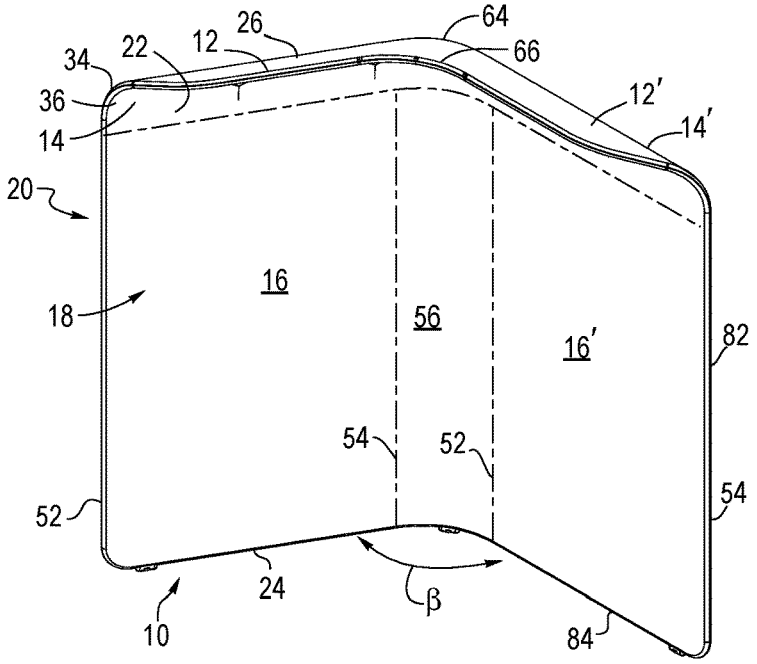
Figure 4:
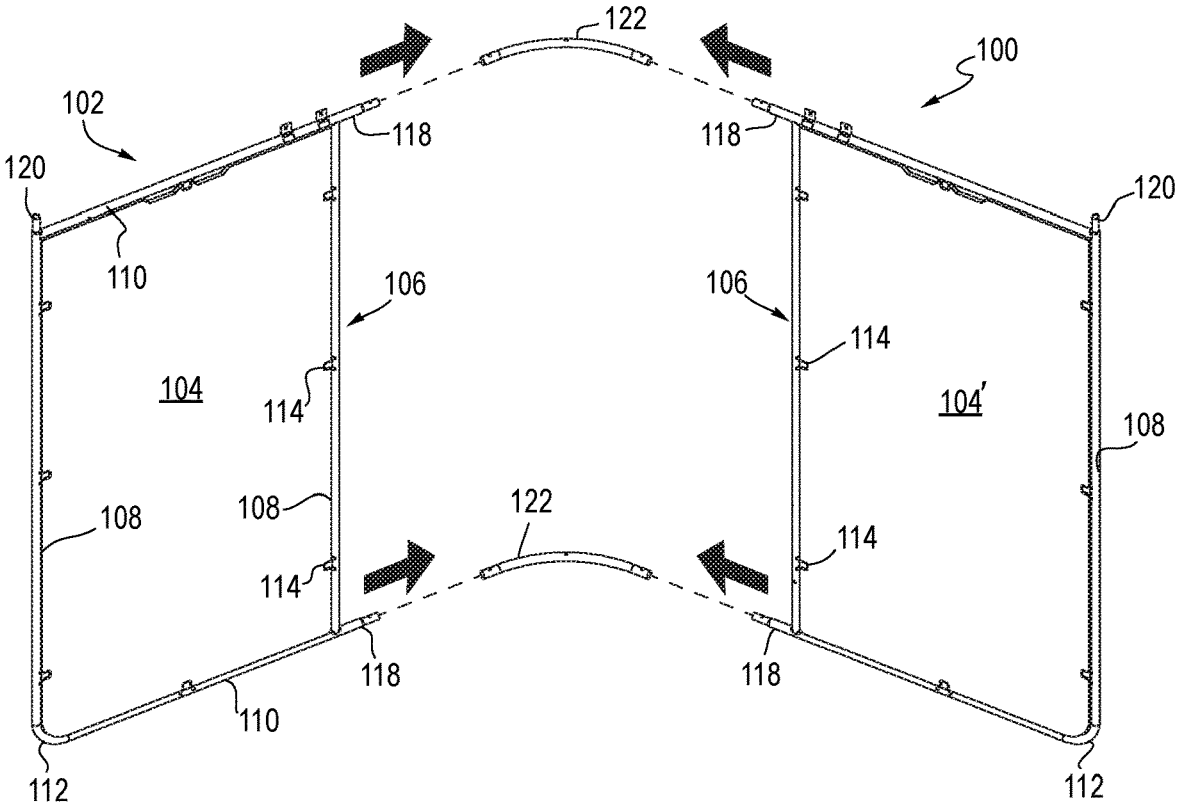
FIG. 4 is an exploded, perspective view of one embodiment of a lower panel subassembly.

In some embodiments, the angle $\alpha$ may be more than 90 degrees, with the overhang extending outwardly and downwardly from the curved transition panel. It should be understood, that the overhang panel may be curved, for example with a concave lower surface curving about a horizontal axis (whether linear or curved), and with a tangent of an intermediate location of the surface forming the angle $\alpha$. In various embodiments, the panel assembly 10 may include a pair of vertical panels 16, 16', each having first and second sides 52, 54. The panels may have the same or different widths. The second side 54 of the first vertical panel 16 is disposed proximate the first side 52 of the second vertical panel 16'. A second curved transition panel 56 is disposed between the second side 54 of the first vertical panel 16 and the first side 52 of the second vertical panel 16'. The curved transition panel 56 has a forwardly facing concave surface 58, and in one embodiment a convex rearwardly facing surface as shown in FIG. 2C. The concave surface 58 is curved about a vertical Y axis 2. The first and second vertical panels form an angle $\beta$ of between and including 60 degrees and 150 degrees, and in various embodiments an angle $\beta$ of 90 or 120 degrees respectively, as shown for example in FIGS. 3A-C.

The overhang panel 12 includes a first overhang panel 12 extending upwardly and outwardly from the first vertical panel and a second overhang panel 12' extending upwardly and outwardly from the second vertical panel. The first curved transition panel 14 is disposed between the first vertical panel 16 and the first overhang panel 12, and a third curved transition panel 14' is disposed between the second vertical panel 16' and the second overhang panel 12'. The curved transition panel 14, 14' each include a forwardly facing concave surface 36, 36', for example curved about a horizontal axis. A fourth curved transition panel 60 is disposed between the first and second overhang panels 12, 12'. The fourth curved transition panel has a forwardly facing concave surface 62. A corner transition panel 64 is disposed between the first, second, third and fourth curved transition panels 14, 56, 14', 60 wherein the corner curved transition panel 64 has a forwardly facing concave surface 66. It should be understood that the term "panel" refers to a structure that may include a frame, panel substrate and/or cover, meaning in one embodiment the panel includes a cover, while in other embodiments the panel is not configured with a cover.

In one embodiment, a first fabric layer 70 is disposed over and defines in part at least the front surface 18 of the vertical panel, the lower surface 28 of the overhang panel and the front concave surface 36 of the transition panel. A second fabric layer 72 is disposed over at least the rear surface 20 of the vertical panel, the upper surface 26 of the overhang panel and the rear surface 34 of the transition panel. In one embodiment, a cover 74 is configured as a pillow-case, or sock, and includes the first and second fabric layers 70, 72, which are joined along three peripheral edges 78, 80, 82, including in one embodiment an upper edge 80 and opposite side edges 78, 82. In one embodiment, the cover may be open at the bottom 84, but includes one or more releasable fasteners 86, e.g., a zipper, snaps and/or a hook/loop fastener, to close at least a portion of the bottom, or releasably secure or join the bottom edges of the first and second fabric layers 70, 72. Additional layers, such as a scrim or sound-absorbing material, may be disposed between one or both of the fabric layers and the underlying panel infrastructure defined for example by upper and lower subassemblies further described below.

The vertical panels 16, 16', overhang panels 12, 12' and transition panels 14, 14', 56, and in particular, the front and lower surfaces 18, 28, 36 thereof, define an interior space 88 or containment space or cavity. The interior space 88 has a footprint defined by the front surfaces 18, 58, 18', and the peripheral edge portion 32 of the overhang panels being projected downwardly to the underlying floor or the worksurface, as shown in FIGS. 2C and D. In operation, the panel assembly 10, and the interior space 88 defined thereby, helps to contain the air flow, for example an exhalation air flow, of a user 90 situated or located in front of the panel assembly 10 and prevent the air in the interior space 88 from flowing or being transmitted to the rear, or second side, of the panel assembly. In particular, the curved transition panels 14, 14', 64, 60 and overhang panels 12, 12' help create a vortex that maintains or recirculates the air flow in the interior space on the front side of the panel assembly 10. Put another way the curved transition panels and overhang panels help create an airflow pattern that prevents the user's exhalations from escaping the panel assembly, or the interior spaced defined thereby.

Panel Subassemblies:

Referring to FIGS. 4-7, a lower panel subassembly 100 defines in part the vertical panels 16, 16' and second curved transition panel 56. The lower panel subassembly includes a frame 102 and one or more substrate panels 104 connected to the frame. In one embodiment, the frame includes a pair of side frames 106, each including a pair of horizontally spaced vertical frame members 108 and a pair of vertically spaced horizontal frame members 110 joined at their respective corners to define an opening therebetween. A lower, outer corner 112 may be curved. The substrate panels are disposed in the opening and are each secured to the frame 102 with a plurality of clips 114. The substrate panel may be tackable, or be capable of attracting a magnet, and may be made for example of fiberglass, plastic, metal, cork board, PET, and combinations thereof. The substrate panels 104 may be planar, or curved. In one embodiment, the frame members 108, 110 may be configured as rods, which may have a tubular or solid construction. The horizontal frame members 110 each include an extension portion 118 that extends inwardly from the vertical frame member. The outer vertical frame member also include an upstanding extension portion 120.

A pair of curved frame members 122 are joined with the extension portions 118 to define in part the curved transition panel 56, and in particular the boundaries or periphery thereof. In one embodiment, the frame members 122 are joined to the extension portions 118 with a spring-loaded detent. One or more curved substrate panels 124 are connected to the vertical frame members 108 and/or the curved frame members 122, for example with a plurality of fasteners 126, which may be configured as screws, tabs, hook/loop fasteners, ties, or other suitable attachment configurations. In one embodiment, a pair of curved substrate panels 124 are connected to the frame 102, one above the other. The substrate panels 124 each have a forwardly facing concave surface, which is curved about a vertical Y axis 2. Each curved substrate panel 124 includes one or more (shown as two) upstanding flanges 127, which underlie or overlie and edge of an adjacent panel, panel substrate or frame to assist in limiting/preventing any air flow through the curved transition panel.

Figure 5:
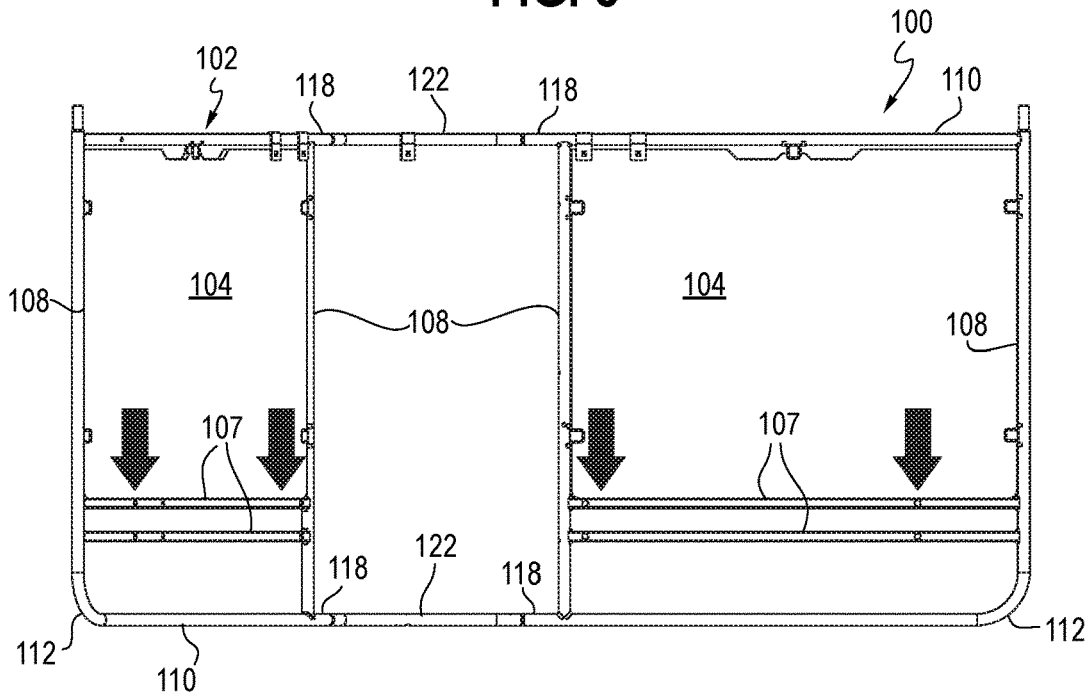
FIG. 5 is a front view of another embodiment of a lower panel subassembly.
Figure 6:
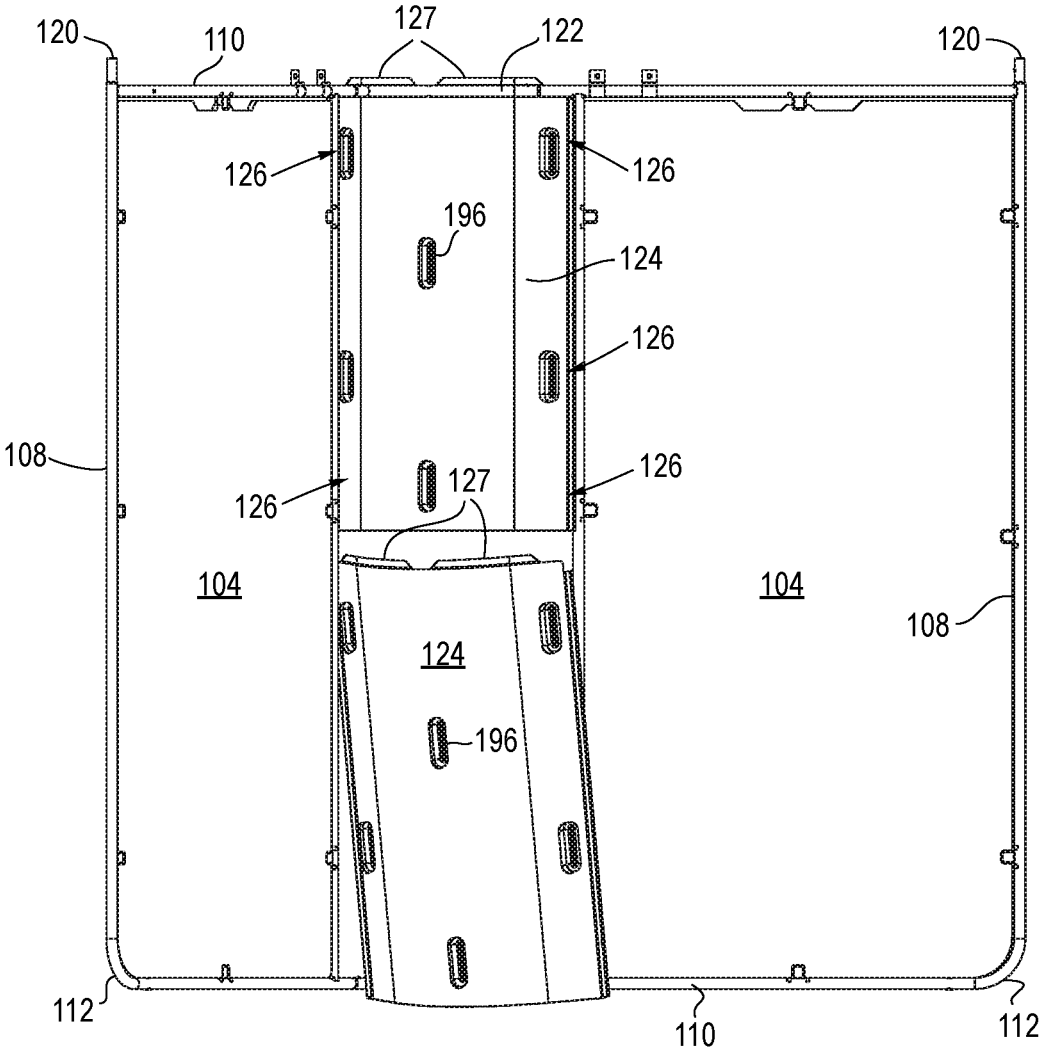
FIG. 6 is a front, partially exploded view of the lower panel subassembly shown in FIG. 4 with a pair of transition panels.
Figure 7:
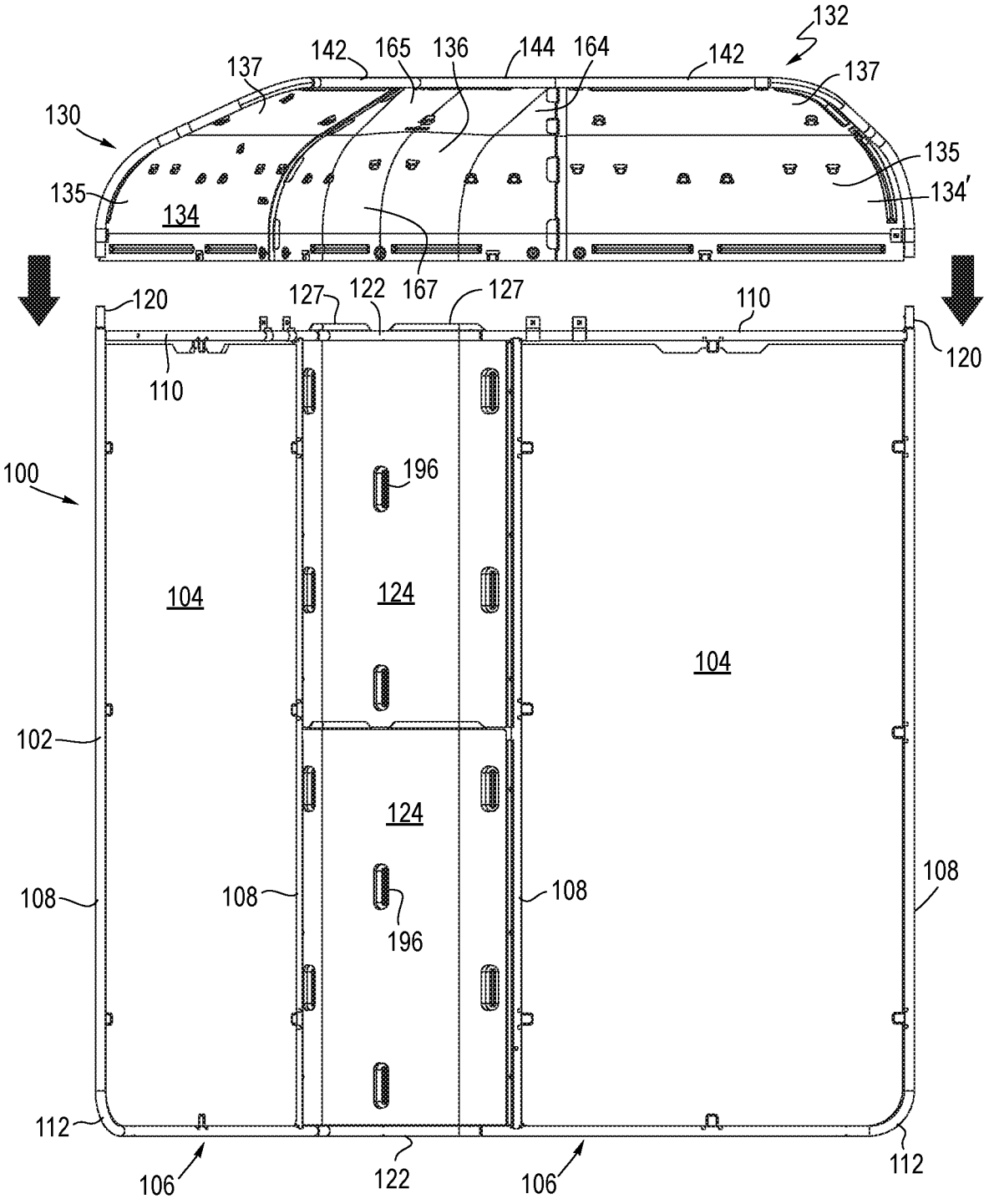
FIG. 7 is an exploded front view of one embodiment of an upper panel subassembly being applied to a lower panel subassembly.
Figure 8:
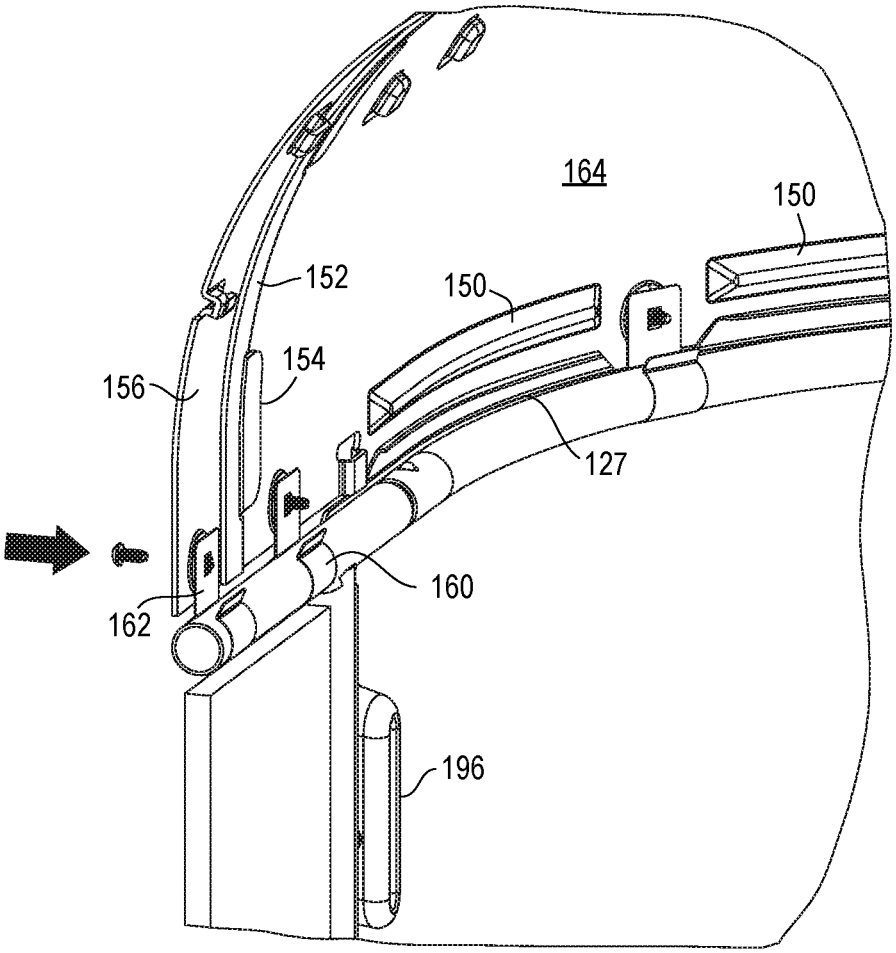
FIG. 8 is a partial, enlarged view of an upper panel subassembly being applied to a lower panel subassembly.

Referring to FIG. 5, the side frames 106 of a desk mounted version of the lower panel assembly 100 each includes a pair of vertically spaced horizontal frame members 107 extending between and connected to the vertical frame members 108. The frame members 107 include mounting locations for receiving the fasteners to secure the mounting brackets 38.

Referring to FIGS. 7-9C, an upper panel subassembly 130 defines the overhang panels 12, the curved transition panels 14, 14', 60 and the curved corner transition panel 64. The upper panel subassembly includes a frame 132 and one or more substrate panels 134, 134', 136 connected to the frame. In one embodiment, the frame includes a pair of horizontally spaced side frame members 138 and an upper frame member 140, which defines an outer peripheral edge 32, or outer edge portion of the overhang panel, which is covered with a cover 74 or fabric in one embodiment. The upper frame member 140 may include a pair of linear segments 142 that are parallel to the horizontal frame members 110 of the lower frame subassembly, although they may be shorter in one embodiment. The upper frame member 140 further includes a curved segment 144 disposed between the linear segments 142. The linear and curved segments 142, 144 may be integrally formed as a unitary member, or separately formed and joined. The side frame members 138 have curved bottom and upper portions 146, 148, with the bottom portion 146 joined with the upstanding extension portion 120 of the lower frame subassembly. The side frame members 138 extend forwardly and inwardly from the lower frame 102 so as to define a tapered configuration.

A pair of side substrate panels 134, 134' are secured opposite the side frame members 138 and linear segments 142. Each side substrate panel 134, 134' defines in part the overhang panel 12 and the curved transition panel 14, which are integrally formed as a unitary component or panel. In one embodiment, an upper portion 137 of the substrate panels 134, 134' are planar, while a lower portion 135 is curved, and has a forwardly facing curved surface that is curved about a horizontal axis. The substrate panels 134, 134' may include a plurality of stiffening ribs 150 disposed around the outer periphery of the substrate panel. An inner side edge 152 of each side substrate panel includes one or more flanges 154 offset from the front or inner surface 156 of the substrate panels. The flanges extend laterally inwardly. The side substrate panels 134, 134' may be secured to the horizontal frame member 110, the linear segments 142 and the side frame 138 with a plurality of clips 158, configured for example with a loop 160 that surrounds the frame members and a flange 162 that may be secured to the substrate panel with a fastener, such as a screw. It should be understood that other fasteners, such as ties or straps, may be used to secure the substrate panels to the frame.

A middle, or intermediate/inner, substrate panel 164 includes a pair of side edges 166 that overlap with the flanges 154 and are parallel to the inner side edges 152 of the side substrate panels. The intermediate substrate panel may also include stiffening ribs 150. The intermediate substrate panel 164 has an upper portion 165 that defines in part the fourth curved transition panel 60 and a lower portion 167 that defines in part the corner transition panel 64, both of which have a forwardly facing concave surface, which may have a compound curvature. The intermediate substrate panel 164 may be coupled to the horizontal frame member 110, the curved frame 122 and/or to the curved frame members 144 with clips 158, or other suitable fasteners. By securing the side frame members 138 and the side and intermediate substrate panels 134, 134', 164, to the horizontal and/or curved frame members 110, 122, 140, 144, the upper panel subassembly 130 may be coupled to the lower panel subassembly 100.

When connected, any gaps between adjacent substrate panels 104, 124, 134, 134', 164, which are substantially air impermeable and made for example of metal or plastic, and/or frame members are eliminated, which limits and/or substantially eliminates, any air flow from a front/inner side of the panel assembly 10, for example as produced by the exhalation flow path of a user 90 positioned on the front/inner side, to a rear/outer side of the panel assembly. In addition, the overhang panels 12 and the various curved and corner transition panels and panel substrates help contain the exhalation flow, maintaining the air from the exhalation flow on the front side and interior space 88 of the panel assembly. The curved transition and corner panels 14, 14', 56, 60, 64 assist in creating an exhalation flow path vortex, that circulates the air on the front/inner side of the panel assembly. In this way, co-workers 91 on the rear/outer side of the panel assembly 10 are isolated from the exhalation flow of the user, and the ambient air environment, on the front/inner side and interior space 88. This isolation may assist in mitigating the transmission of various air born contaminants, thereby reducing obnoxious odors or other contaminants disposed in the ambient air environment of the front/inner side and interior space 88 of the panel assembly. In essence, the various embodiments of the panel assemblies create and define the contained user, interior space 88 or cavity.

The side and intermediate substrate panels 134, 134', 136 may be formed separately, or may be formed integrally as a single or unitary substrate panel. Likewise, the substrate panels 104 and the curved substrate panel 124 of the lower frame subassembly may be integrally formed as a single or unitary substrate panel. In one embodiment, all of the substrate panels of the upper and lower frame assemblies may be integrally formed as a single panel, or any two or more adjacent substrate may be integrally formed. In various embodiments, for example where the substrate panels are integrally formed such that panel assembly is self-supporting, one or more (or all) of the frame members may be omitted thereby providing a frameless panel structure, or monolithic panel, which may be covered with fabric. The various substrate panels may be made of a rigid, or semi-rigid material, including the material described herein above.

Figure 9A:
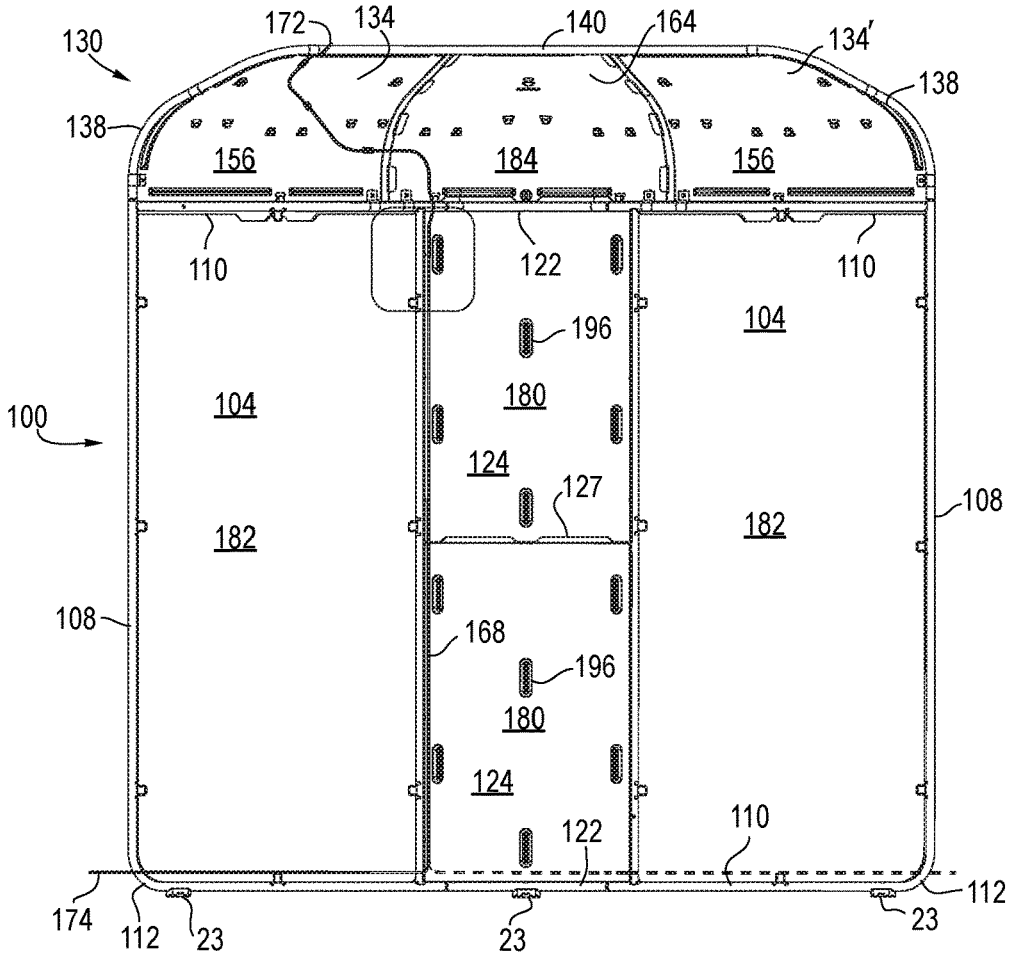
FIG. 9A is a front view of one embodiment of a panel subassembly.
Figure 9B:
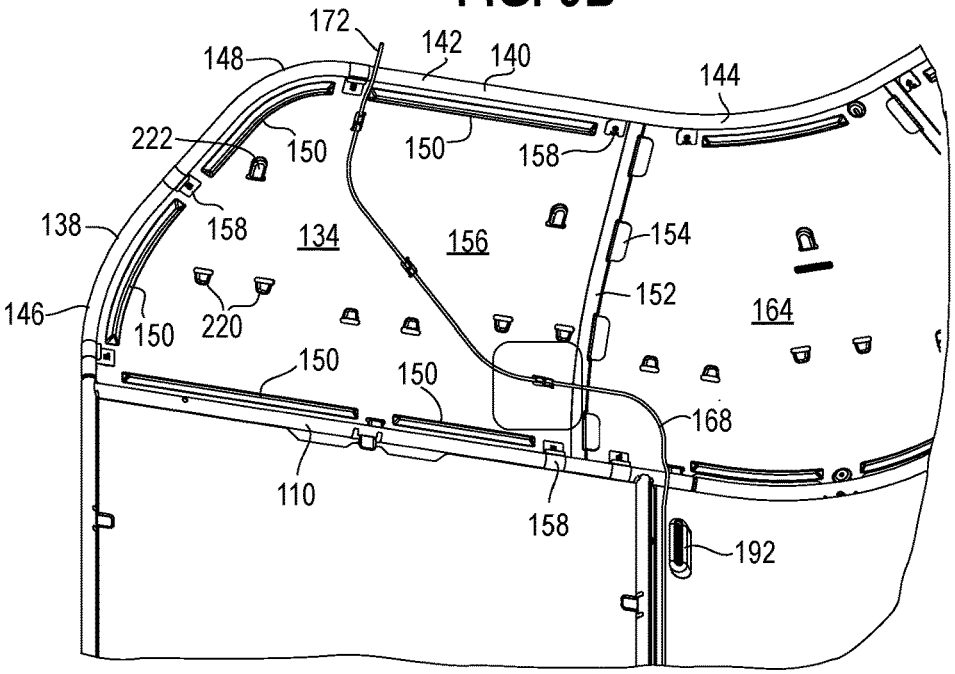
FIG. 9B is a partial front view of the panel subassembly shown in FIG. 9A.
Figure 9C:
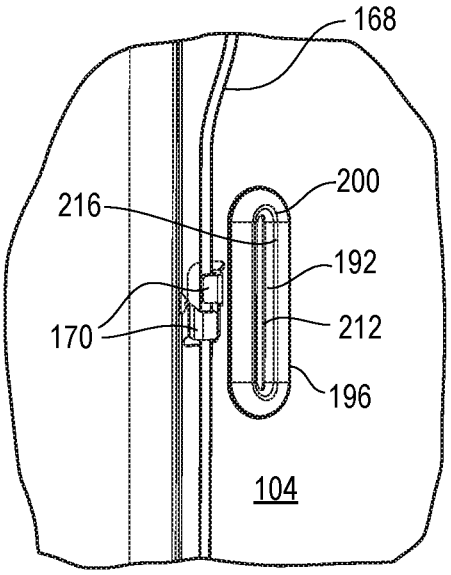
FIG. 9C is a partial front view of the panel subassembly showing one embodiment of a mounting member and a cord clip.

Referring to FIGS. 9A-C, one or more cords 168, including for example power and/or data cords, may be secured to the upper and lower panel subassemblies 130, 100. In one embodiment, the cord 168 may be configured as a power cord having a first end 172 disposed at the outer edge portion of the overhang panel, and extending at least a first predetermined length from the edge, for example 1.5 inches. The cord 168 is routed along the various panels, and may be secured to the panel substrates with a pair of closely spaced and offset clips 170, with the cord being threaded through and retained by the clips. A second end of the cord 174, which may include a plug, may extend from the panel assembly at any location, for example a bottom of one of the sides as shown in FIG. 9A. The cord is routed along the surface of the panel and is disposed between the panel surface and the inner surface of a fabric layer.

Referring to FIGS. 9A-12, the vertical, overhang and curved transition panels each have one or more substrates, configured in one embodiment as the substrate panels 104, 124, 134, 134', 164, defining a front or inner substrate surface 156, 180, 182, 184, with the substrate surfaces defining in part respective portions of the front surface 18 of the vertical panels 16, 16', the lower surface 28 of the overhang panel 12, 12' and the front surface 36 of the curved transition panel 14, 14'.

Figure 16:
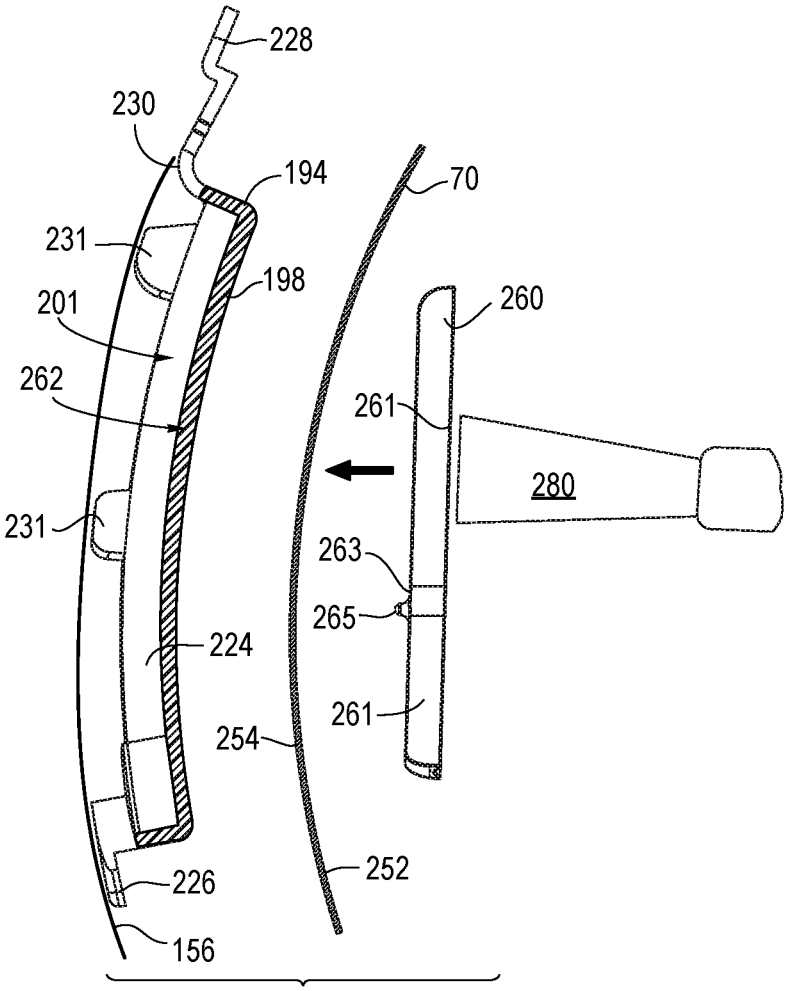
FIG. 16 is a partial, side view of a stay, fabric layer and panel subassembly.

One or more of the substrates, or substrate panels 104, 124, 134, 134', 164, may be configured with openings 190, 192. In one embodiment, one or more of the substrate panels 104, 124, 134, 134', 164 may be configured with one or more mounting members 194, 196 coupled to the substrate, whether integrally formed as part of the substrate, or mechanically coupled to the substrate. Each of the mounting members 194, 196 includes a front mounting surface 198, 200 spaced forwardly and/or downwardly from the front substrate surface 156, 180, 182, 184 respectively. One of the openings 190, 192 is disposed on the mounting member 194, 196 and extends through the front mounting surface 198, 200. It should be understood that the openings may be formed directly through the front surface of the substrate panel, rather than being offset from the front surface by way of the mounting member. Due to the offset spacing of the mounting surface 198, 200, and opening 190, 192, from the surface 156, 180, 182, 184 of the substrate panel, the mounting member 194, 196 defines a cavity 201, 202 on a rear side of the mounting member but in front of a rear surface of the substrate panel, as shown in FIG. 16, wherein the cavity 201, 202 communicates with the opening 190, 192. It should be understood that the opening may be configured in any number of different shapes, lengths, and widths.

In one exemplary embodiment, the opening 192 is shaped or configured as a line segment 206, which may be linear, curved or curvilinear. In another exemplary embodiment, the opening 190 comprises a plurality of line segments 208 extending from a common vertex 210. The line segments 206, 208 may be linear, curved, curvilinear and have different lengths. In one embodiment, the opening 190 includes three line segments 208 extending from the common vertex 210. The three line segments 208 may be angularly spaced at 120 degree intervals, or other non-symmetrical angular intervals. The openings 190, 192, and line segments 206, 208, each comprises a mouth 214, 216 configured with a tapered entry surface 212 extending around at least a portion of the periphery of the opening, as shown for example in FIGS. 19A and B. The tapered entry surface may extend around the entire periphery of the opening 190, 192 in one embodiment. Due to the tapered configuration, the mouth has inwardly turned edge portions that are directed away from an insertion direction and which define, in combination, a catch.

Figure 10:
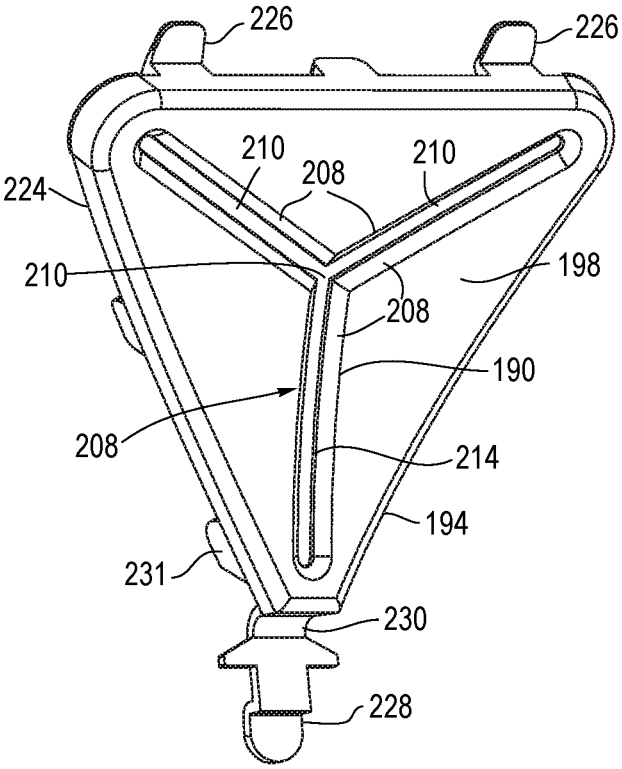
FIG. 10 is a perspective view of another embodiment of a mounting member.
Figure 11A:
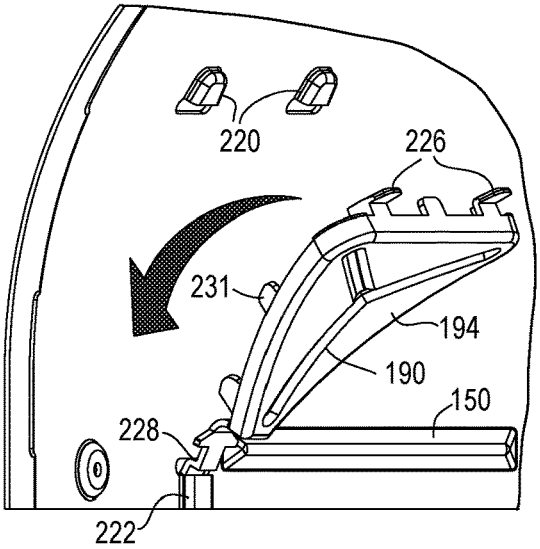
FIG. 11A-D are views showing a mounting member being installed on a panel substrate.
Figure 11B:
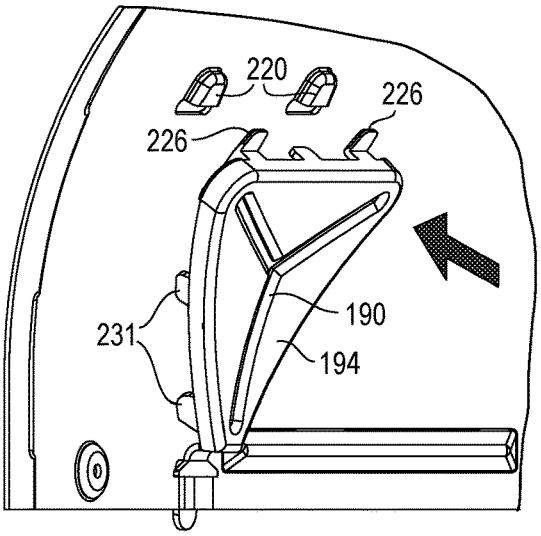
Figure 11C:
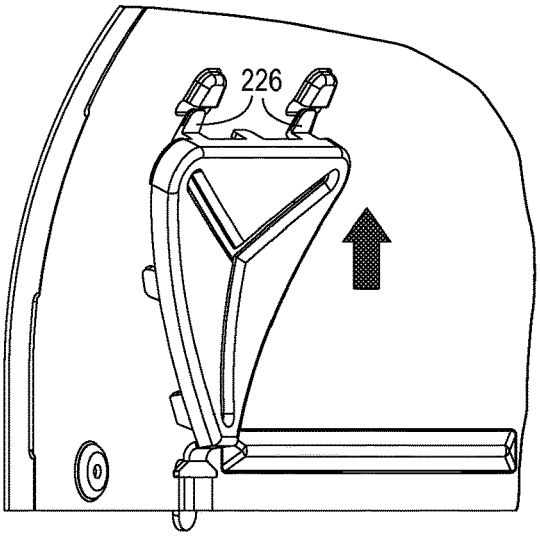
Figure 11D:
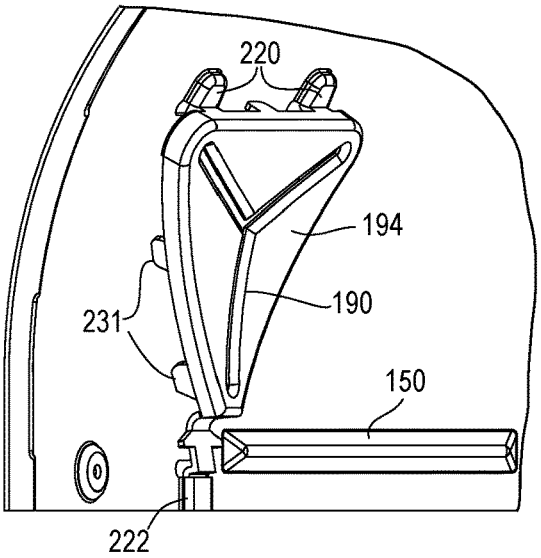
Figure 12:
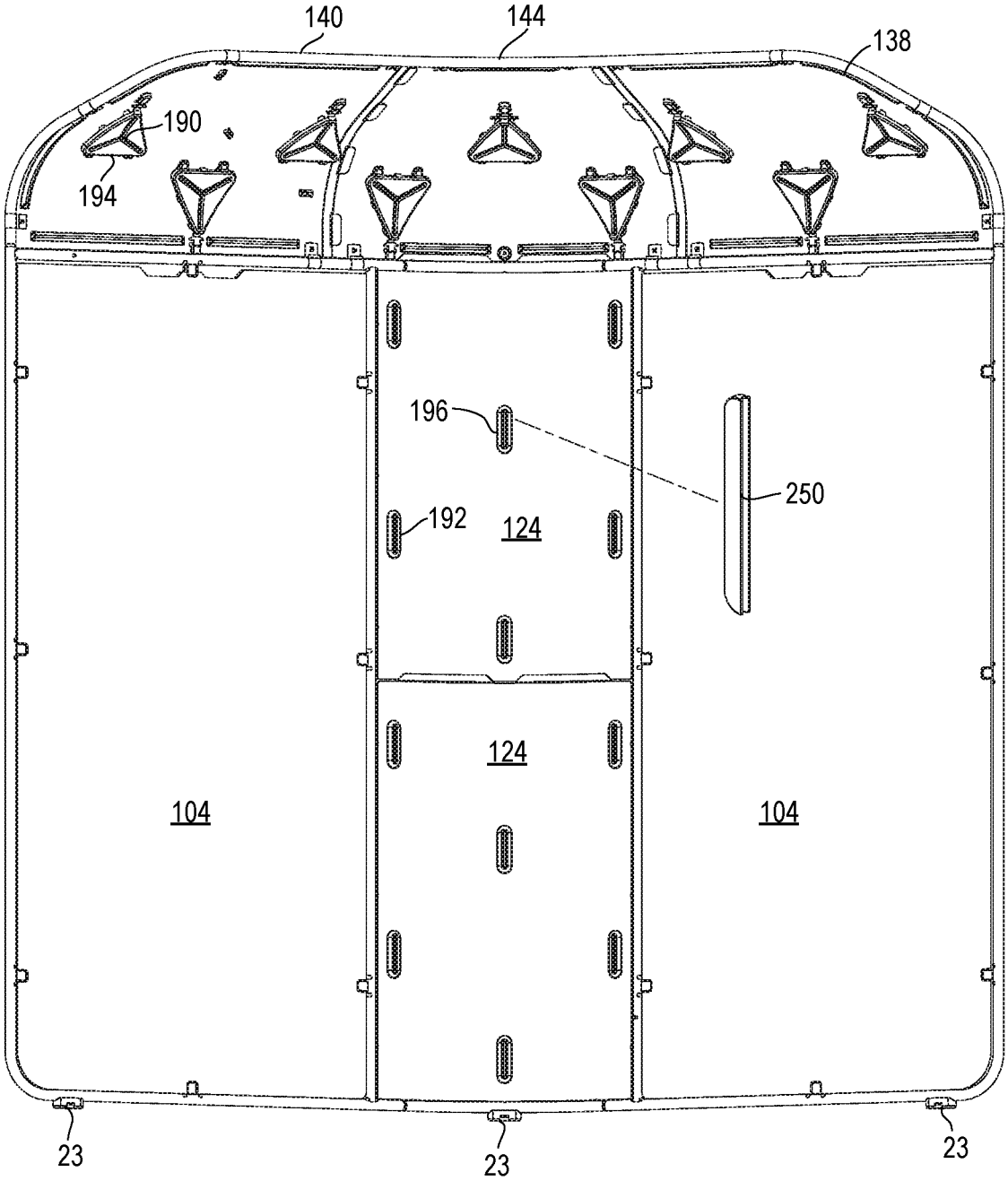
FIG. 12 is a front view of a panel subassembly without the cover attached.

Referring to FIGS. 10-11D, the mounting member 194 is shown as being formed separately from the substrate panels 134, 134', 164, although it should be understood that they may be integrally formed. The substrate panels 134, 134', 164 may include a plurality of tabs, or receptacles 220, 222. In one embodiment, the substrate includes a plurality of sets of receptacles, including for example and without limitation three receptacles, with two receptacles 220 being aligned and opening in a first direction, and a third receptacle 222 spaced from the two receptacles and opening in a second direction opposite the first direction, with the set of three receptacles defining a triangular pattern. Various sets of receptacles may be staggered along the curved and corner transition panels, or substrates panels 134, 134', 164, with the sets having alternating orientations. The receptacles each define a socket. The mounting member 194 includes a triangular shaped front mounting surface 198, a peripheral side wall 224 surrounding the front mounting surface 198, a pair of tabs 226 extending from one edge of the side wall and a third tab 228 extending from an apex of the side wall. One or more standoff tabs, or spacers 231, may extend rearwardly from the side wall 224. The tabs 226, 228 are spaced and shaped to be received in the receptacles 220, 222. It should be understood that the tabs may be formed on the substrates, and the receptacles, with sockets, formed on the mounting members. The tab 228 at the apex includes a flex portion 230, allowing the tab to be flexed.

In operation, the two tabs 226 are inserted into the receptacles 220, and the mounting member 194 is rotated until the third tab 228 may be snapped into the third receptacle 222. Or, the third tab 228 is installed in the receptacle 222 and the mounting member 194 is pushed and/or rotated to bend the flex portion 230 such that the tabs 226 may be inserted into the receptacles 220. Once installed, the front mounting surface 198 is laterally spaced from the substrate surface 156, for example in the Z direction 6. This spacing facilitates the routing of the cord between the substrate and the fabric layer. The spacers 231 may help support the mounting member on the substrate panel. It should be understood that the mounting surface 198 of the mounting member 194 may define in part the first and second sides of the panel, even though the panel substrate 134 underlying the mounting member also has first and second sides. In other words, even if the panel has several layers, e.g., substrate panel 134 and mounting member 194, the layer, or surface 198, with the opening 190 that receives a stay and a portion of the fabric, as further described herein below, defines the first and second sides of the panel at that location.

Figure 19A:
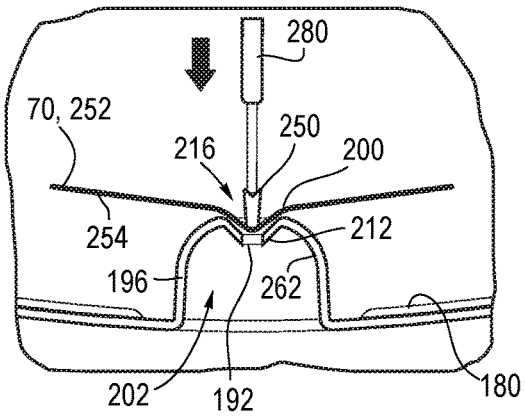
FIG. 19A is a partial, cross-sectional view showing a stay in a non-engaged position being applied to a fabric layer and mounting member.

In another embodiment, shown in FIGS. 9C and 19A and B, the mounting member 196 is configured as an elongated domed portion extending inwardly/forwardly from the substrate surface 180. The opening 192 is formed through a front/inner mounting surface 200 of the domed portions, which surface is spaced from the substrate surface 180, for example in the Z direction 6, and with the dome defining the cavity 202. In one embodiment, the opening 192 is a linear opening. In one embodiment, the depths of the domed portions, or cavity 202, are substantially the same as the depths of the mounting members or cavity 201.

Figure 13:
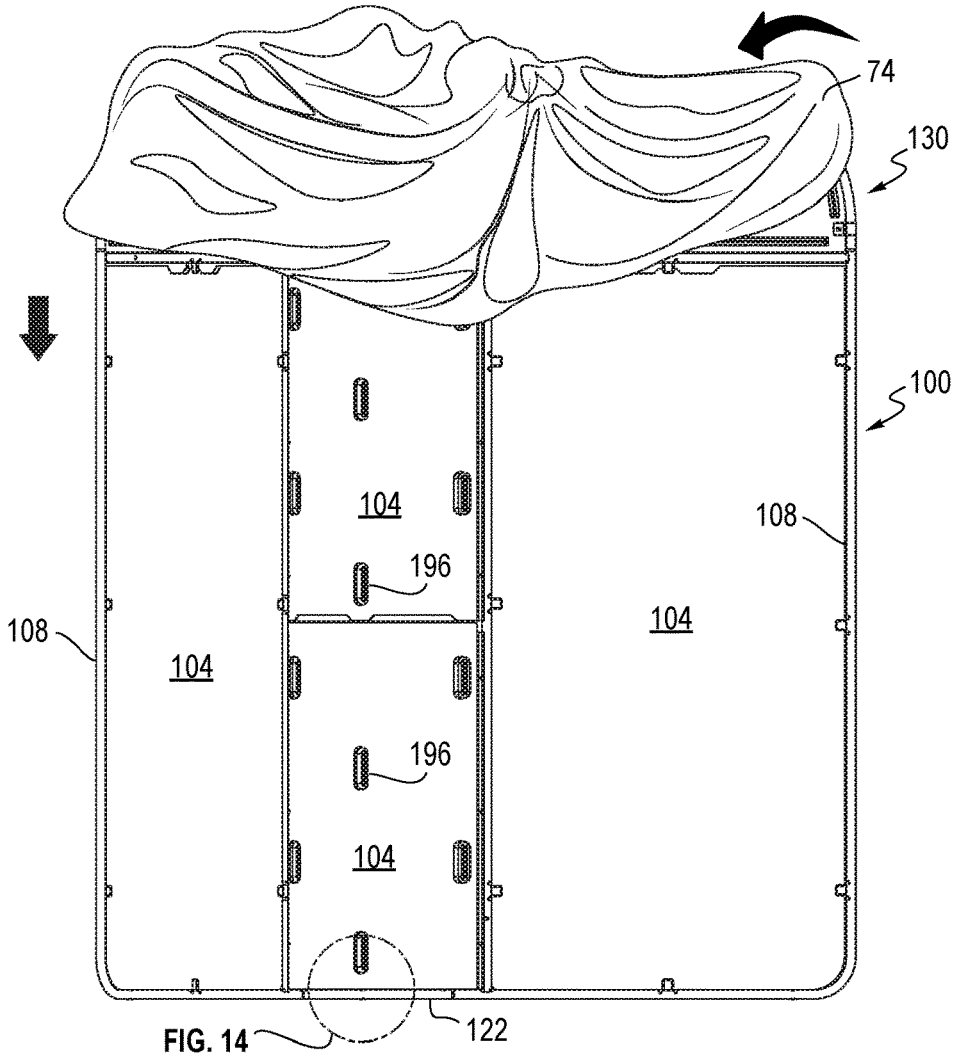
FIG. 13 is a perspective of a cover being installed on the panel subassembly shown in FIG. 12.
Figure 14:
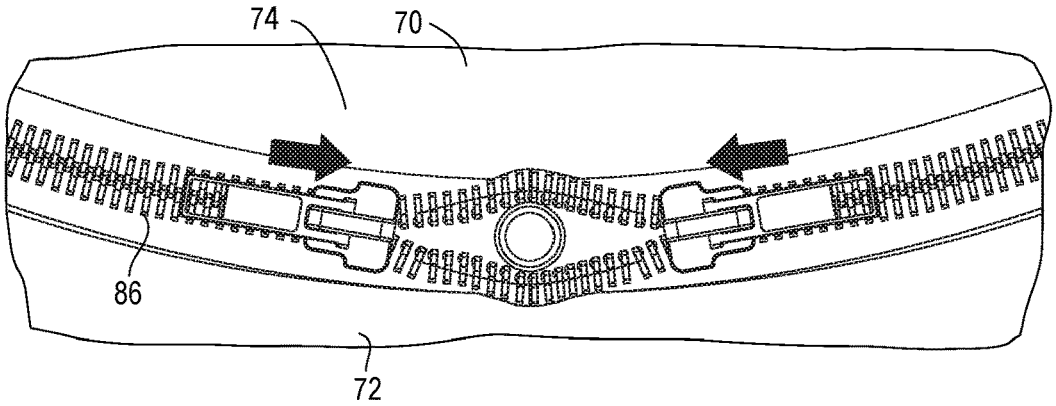
FIG. 14 is an enlarged partial bottom view of a cover being installed on the panel subassembly.
Figure 15:
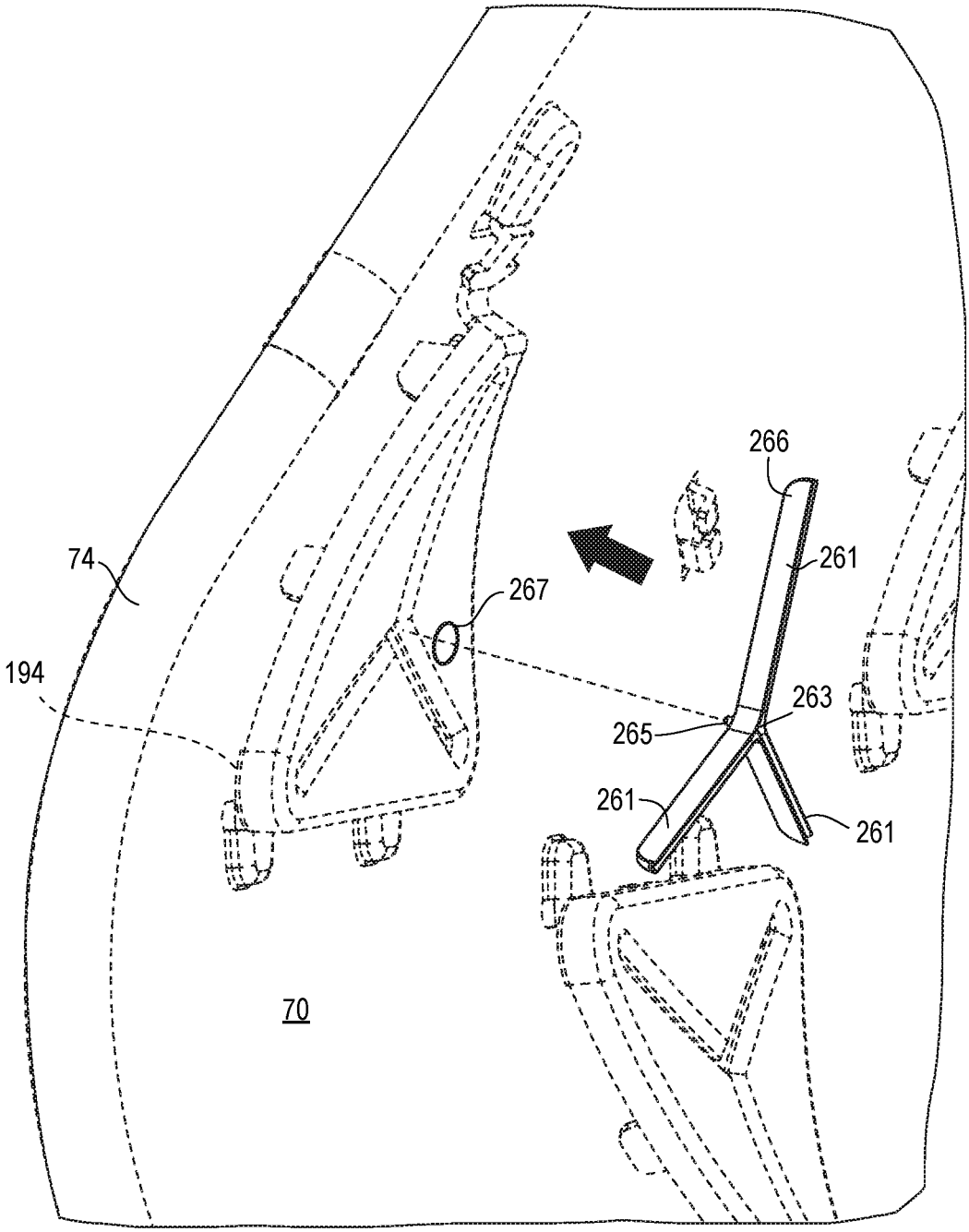
FIG. 15 is a partial view of a stay being applied to a fabric layer and panel subassembly.

Cover Assembly:

Referring to FIGS. 13 and 14, the cover 74 may be disposed over the cord 168 and assembled upper and lower panel subassemblies 130, 100, with the subassemblies being threaded between the front and rear layers 70, 72 through the open bottom 84 of the cover. Once the cover is disposed over the upper and lower frame assemblies, the bottom edges of the first and second fabric layers may be releasably secured, for example with a zipper 86.

Referring to FIGS. 15-17B, 19A and 19B, a stay 250, 260, configured in one embodiment as a bar, is positioned adjacent an outer surface 252 of the front fabric layer 70 in an overlying relationship with one of the openings 190, 192. The stay may be rigid, made for example of metal or hard plastic, such that it does not elastically deform during the installation process in one embodiment. In one embodiment, the fabric layer 70 covers at least a portion of the first side of the panel and includes a first, inner surface 254 facing toward the first side of the panel and a second, outer surface 252 facing away from the first side of the panel.

Figure 17A:
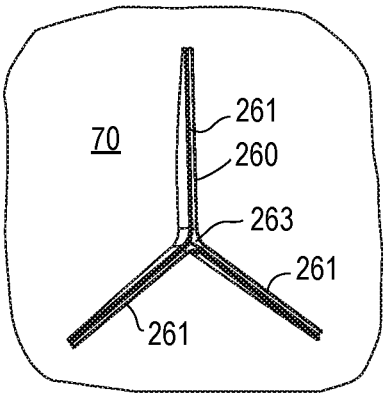
FIG. 17A is a partial view of the stay in a non-engaged position before being applied to the fabric layer.
Figure 19B:
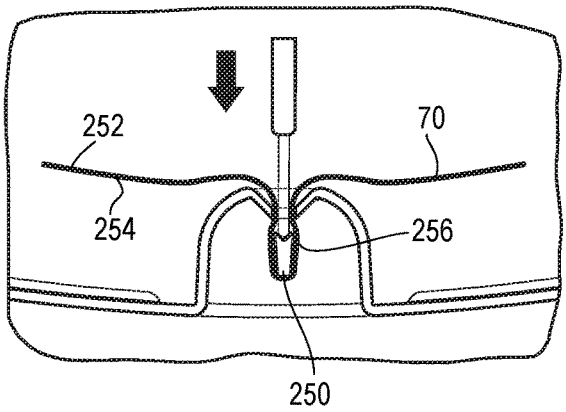
FIG. 19B is a partial, cross-sectional view showing the stay in an engaged position.
Figure 20:
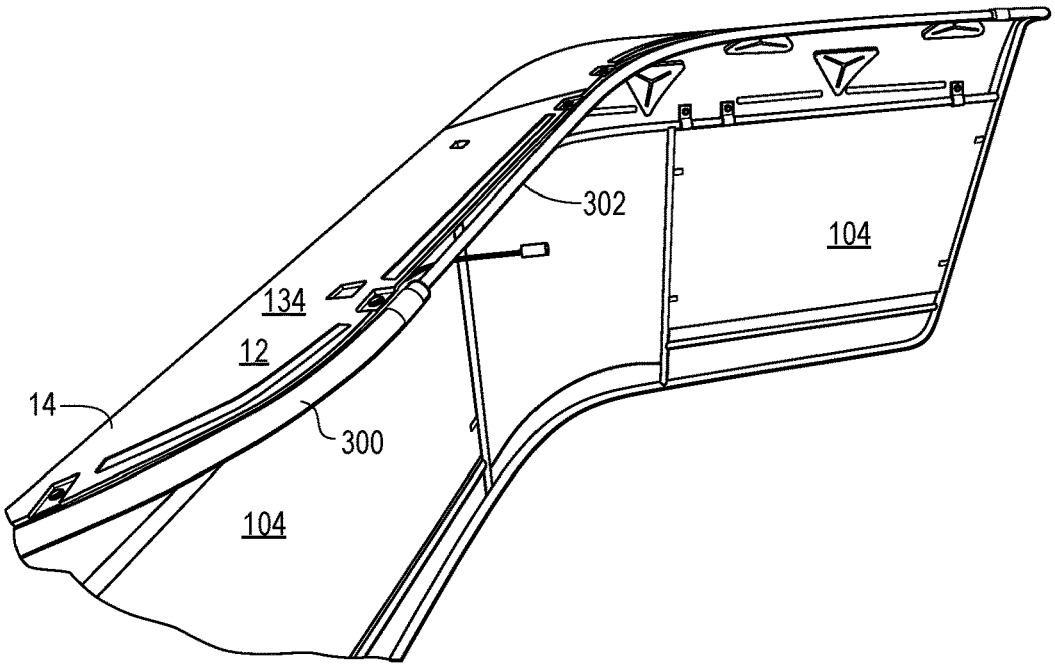
FIG. 20 is a partial, upper perspective view of an upper frame subassembly.
Figure 21:
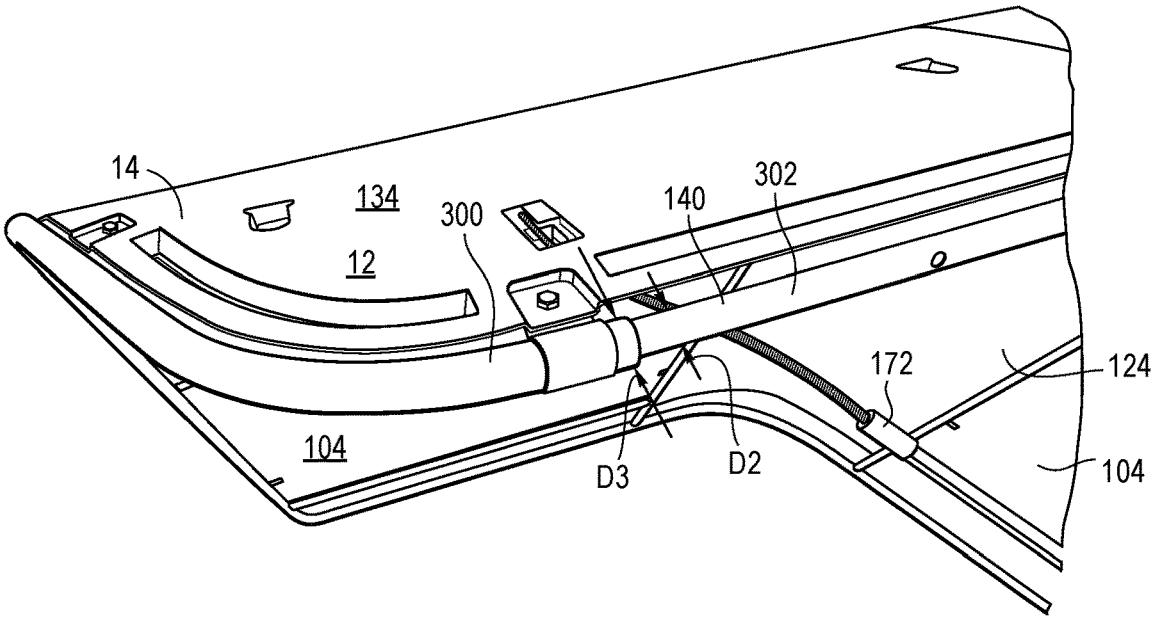
FIG. 21 is partial, view of the upper frame shown in FIG. 20.

In operation, the stay 250 is engaged with the second surface 252 of the fabric layer. The stay 250 and a portion 256 of the fabric layer, which is looped around and surrounds the stay, are inserted through the opening 190, 192 and disposed on the second side of the panel, e.g., a second side 262 of the mounting member defining in part the panel. In one embodiment, the stay 250, 260 has the same shape as the underlying opening 190, 192, e.g., linear bar, 3-segment bar, or star, etc., and may be configured for example with three arms 261 joined at a vertex 263 as shown in FIG. 17A. The fabric engaging/facing side of the stay may have tapered ends on each arm, and a locator protuberance 265 that locates the stay on the opening, and may be aligned with an opening 267 formed in the fabric layer 70 or cover 74. The stay 250, 260 is moved from a disengaged position with the fabric through the mouth 214, 216 of the opening to an engaged position, wherein the stay 250, 260 and a portion 256 of the fabric layer 70 are inserted through the opening and disposed in the cavity 201, 202 on the opposite side of the panel. The mouth 214, 216, defining the catch, may slightly, elastically deform, or open, to allow the passage of the stay 250, 260 and surrounding fabric portion 256, and thereafter trap and hold the stay and fabric with a snap-fit as shown in FIG. 19B. The stay 250, 260 and portion of the fabric portion 256, which is double layered at the junction of the mouth, fill and close the opening 190, 192 thereby preventing air from flowing through the openings 190, 192.

A grippable tool 280, such as a screw driver or putty knife with a knife edge, may be pressed against a surface of the stay 250, 260, which may be configured with a groove to locate the tool, so as to apply an insertion force to the stay and fabric portion 256. Due to the portion 256 of the fabric being located in the cavity, and the double layer of the fabric closing or filling the mouth, the remaining portion of the fabric on the front/inner side of the panel assembly is pulled tight, or put in tension to provide a smooth surface along the front/inner surface of the panel assembly. In one embodiment, the cover fabric may be a 3-D knit material, which allows the fabric to stretch and conform to the shape of the panel. The term "fabric" refers to a flexible material made of a network of natural or artificial fibers (yarn, monofilaments, thread, etc.). The fabric may be formed by weaving, knitting (e.g., 3-D knitting), crocheting, knotting, felting, and/or braiding. The cover may also be made of one more layers of a thin sheet (e.g., film or leather).

Figure 17B:
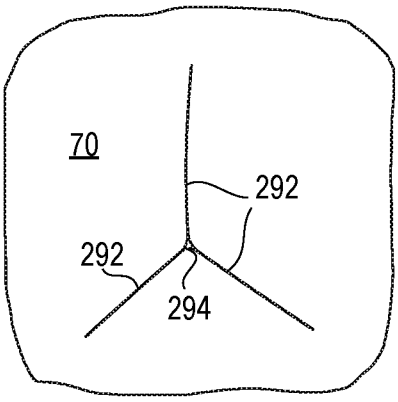
FIG. 17B is a partial view of the front surface of the fabric layer after the stay is applied to the fabric layer and secured to the mounting member in an engaged position.
Figure 18:
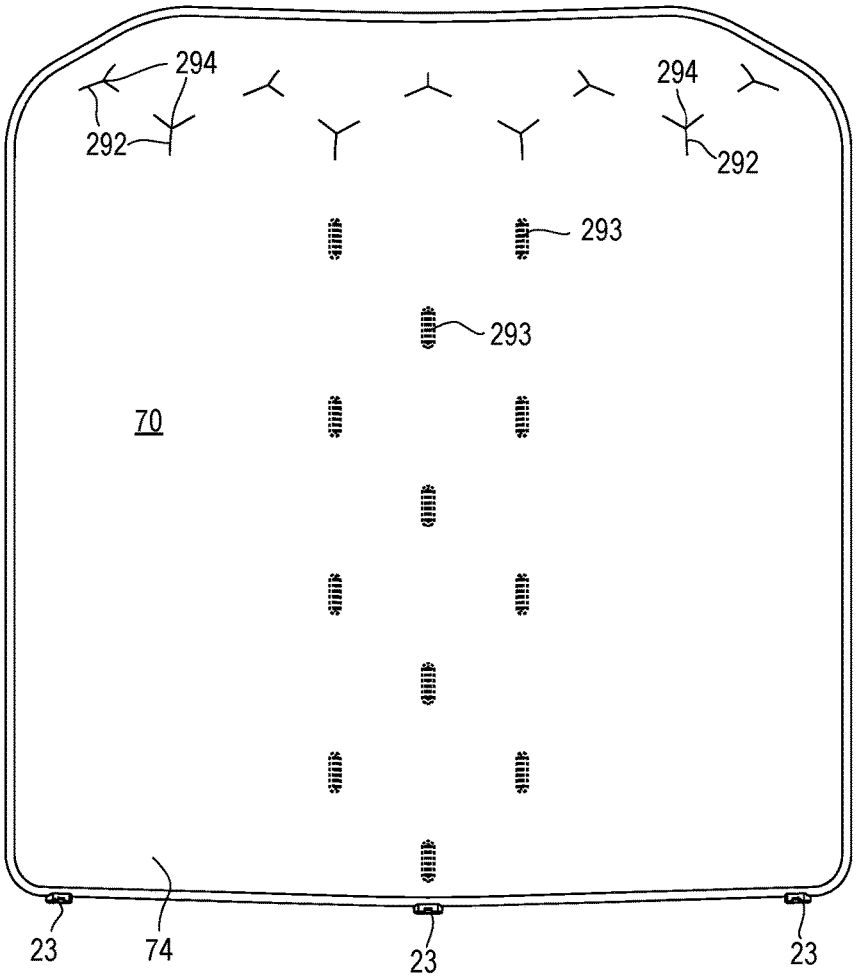
FIG. 18 is a front view of a panel assembly.

As shown in FIGS. 1, 17B and 18, the front surface 252 of the fabric includes a plurality of seams 292 extending from a common vertex or junction 294, and having a shape matching the shape of the underlying opening 190, and a plurality of seems 293 having a shape matching the shape of the underlying opening 192. In one embodiment, the seams 292, 293 are disposed along the curved portions, or on the curved transition panels, of the panel assembly 10. It should be understood that alternatively the seams may be positioned over the planar portions of the panel assembly. The stays 250, 260 are particularly effective in securing the fabric layer 70 over curved portions of the panel assembly. Because the fabric layer 70 and stay 250, 260 are disposed in the cavity 201, 202, a rear/outer surface of the panel substrate retains a smooth appearance when covered with the fabric layer 72. It should be understood that the stays 250, 260 and mounting members 194, 196 may be used to secure a fabric layer 70 to one or both of a planar surface or a curved surface. It should also be understood that the stay, fabric and opening interface may be used to secure a layer of fabric to a panel, regardless of whether a second fabric layer is disposed on the opposite side of the panel. The stays secure the fabric without the need for auxiliary fastening systems, such as adhesive, mechanical fasteners (e.g., staples) or other devices, which may be expensive, messy and difficult to apply without an attendant improvement of the appearance of the fabric.

Moreover, the attachment system provides for the stays 250, 260, and fabric layers 70, 72 and cover 74 to be removable. For example, pressure may be applied to a rear/outer side of the panel to expand the mouth and thereby permit the stay and fabric to be pushed back through the opening so as to thereby release the fabric layer 70 from the catch and mounting member and be moved to the disengaged position. After the plurality of stays are removed, the bottom of the cover may be released or opened (e.g., unzipped) such that the cover 74 may be pulled off the panel subassemblies 100, 130 for washing or replacement with another cover, or moved to another panel subassembly.

Light Assembly:

Referring to FIGS. 2 and 20-23, the side and upper frame members 138, 140 are configured with various rods, whether tubular or solid, defining the linear and curved segments 142, 144. In one embodiment, the upper frame member includes a rod having a first portion 300, and defining a first edge portion of the overhang panel, with a first cross-sectional area or thickness defined by a first outermost exterior surface and a second portion 302, or edge portion, with a second cross-sectional area or thickness defined by a second outermost exterior surface. For example and without limitation, the first portion 300 may include a corner portion of the side frame and/or portions of the linear segment of the upper frame member, while the second portion 302 may include portions of the linear segment and/or the curved segment, both of which are covered with a fabric, such as cover 74. The first cross-sectional area, or thickness, is greater than the second cross-sectional area, or thickness. In one embodiment, the rods of the frame members are configured as cylindrical tubular members, with the first portion having a first diameter (D1), also defining a thickness, and the second portion having a second diameter (D2), also defining a thickness, with D1>D2 and the difference between D1−D2=D3 being the depth of the step between the first and second portions. The fabric cover 74 surrounds both the first and second portions. In other embodiments, the edge portions 300, 302 may be formed by an edge of a substrate, or a panel, rather than a rod, with the thickness of the respective panels, or portions thereof, being varied. The edge portion, for example the rod, or other frame members, may have a non-circular shape, and may have a polygonal cross-section, for example an edge with corners.

Figure 23:
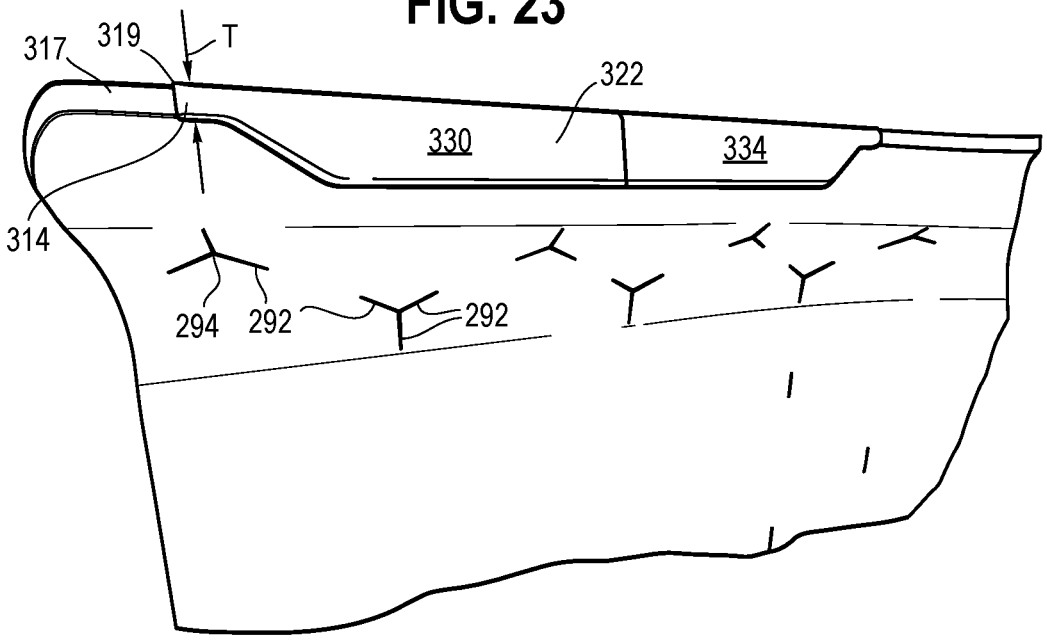
FIG. 23 is a partial, front view of one embodiment of a panel assembly configured with a light assembly.
Figure 24:
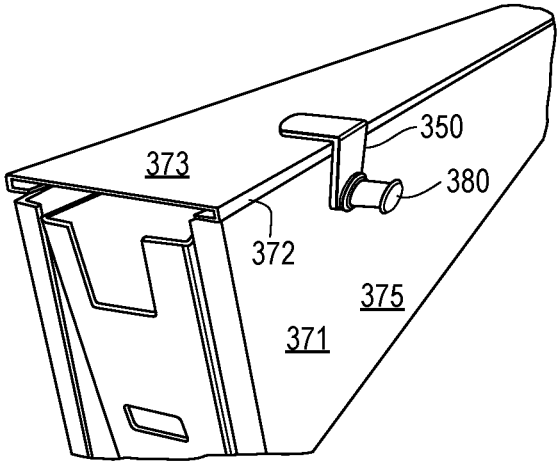
FIG. 24 is a perspective view of a hook assembly applied to a panel.
Figure 25:
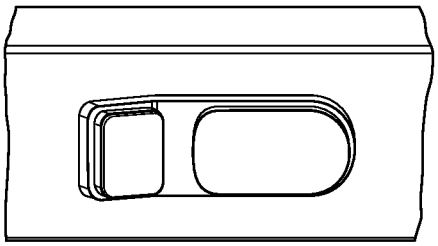
FIG. 25 is a bottom perspective view of the hook assembly shown in FIG. 24.
Figure 26:
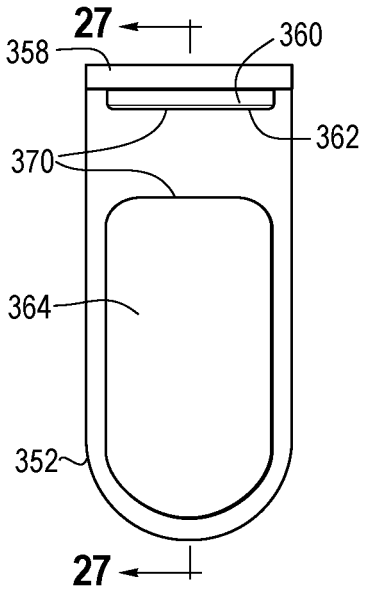
FIG. 26 is a rear view of the hook assembly shown in FIG. 24.
Figure 27:
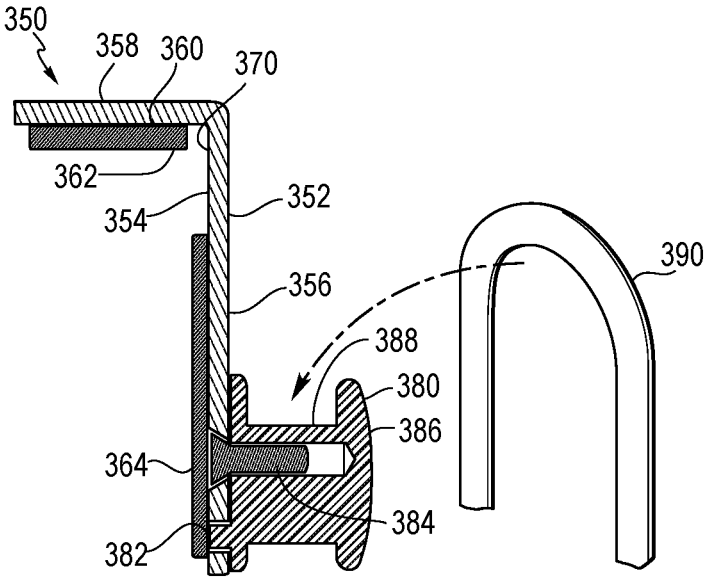
FIG. 27 is a cross-sectional view of the hook assembly shown in FIG. 24.

A light assembly 310 includes a housing 312 with a mounting portion 314 running along one edge of the housing. In one embodiment, the mounting portion 314 may be a clip, and may be configured as a C-shaped clip having engaging portions 321. The light assembly may be attached to the panel using machine screws, with threaded nuts located interiorly in the frame structure, allowing the screws to attach the light assembly to the frame. The mounting portion has end portions 316 that extend outwardly from opposite ends of the housing. The mounting portion surrounds at least two, and preferably at least three sides of the second portion 302 of the edge portion (e.g., rod), covered by the cover 74, with the end portions 316 of the mounting portion abutting the stepped interface between the first and second portions 300, 302. The thickness (t) of the mounting portion 314 is dimensioned such that an outer surface 318 of the end portions 316 of the mounting portion is substantially flush with the outer surface 317 of the fabric cover 74 covering the first portion 300 at the interface 319. In essence, the engaging portions 321 of the mounting portion has a thickness (t) approximating the depth D3, and an overall vertical thickness (T) approximating the total thickness of the edge portion 300 and cover, which may include two layers of fabric as shown in FIG. 23.

Figure 22A:
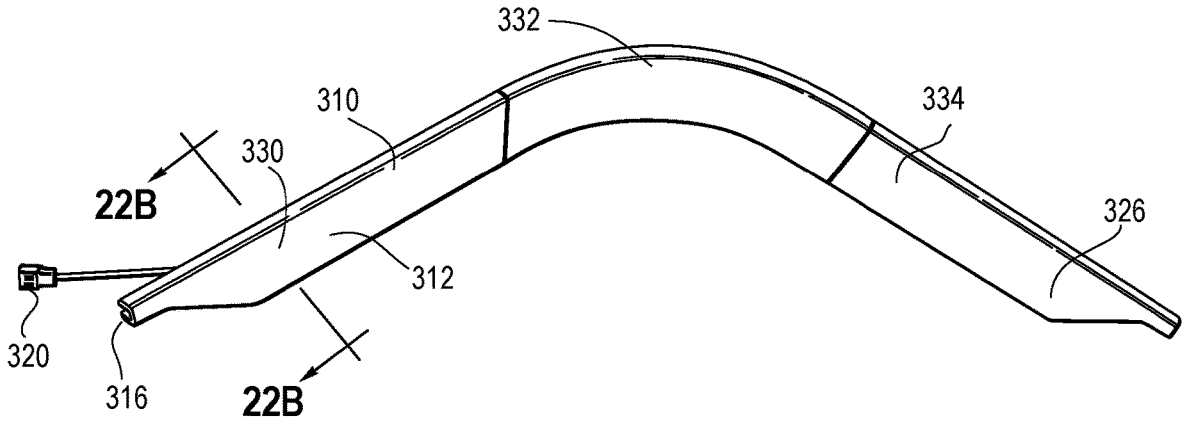
FIG. 22A is a perspective view of one embodiment of a light assembly.
Figure 22B:
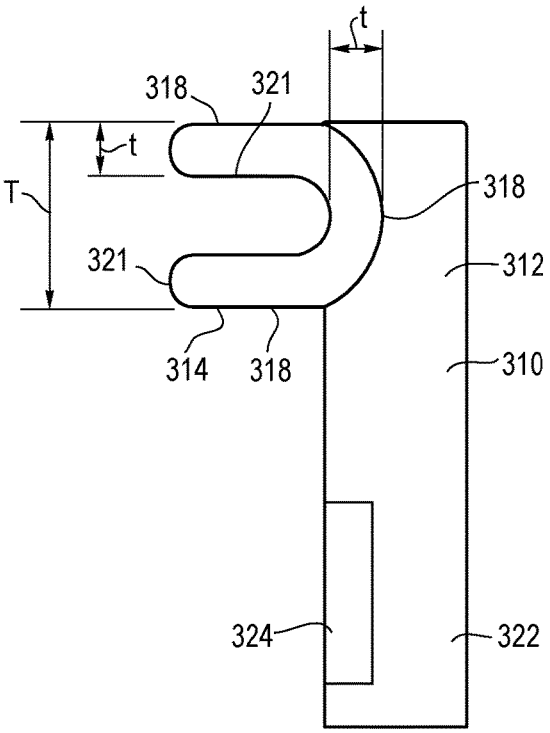
FIG. 22B is a partial cross-sectional view of the a mounting portion of the light assembly taken along line 22B-22B of FIG. 22A.

As shown in FIG. 22A, the light assembly includes a cord 320 having a socket shaped and configured to electrically connect to the first end 172 of the cord, extending through an opening in the cover 74 along the top of the panel assembly 10. The housing 312 includes an enlarged portion 322 extending from the mounting portion. A light source 324, for example LED's, are coupled to the housing, for example along a rear surface of the housing. One or more controls, such as a power switch 326, are disposed on the housing. The housing may include various segments 330, 332, 334 including linear and curved segments, that are dimensioned to match and mate with the upper frame. In one embodiment, the housing is configured only with linear segments. In one embodiment, the housing 312 includes a two-piece clamshell, configure with a top/upper half and a bottom/lower half).

Hook Assembly:

Referring to FIGS. 24-27, a hook assembly 350 includes a vertical flange 352 having a first side 354 and a second side 356. A horizontal flange 358 is connected to the vertical flange and extends laterally in a first direction from the first side 354 of the vertical flange. The vertical and horizontal flanges 352, 358 may be integrally formed as a unitary piece of material, for example from a bent piece of metal or molded plastic. A magnet 360 is coupled to a bottom surface of the horizontal flange 358, for example with an adhesive or fastener. A pad 362, for example made of low-skid material such as rubber, may be applied to a bottom, panel facing surface of the magnet 360. The pad prevents scratching of the underlying panel or other mounting surface, while also having a coefficient of friction that resists a shear force applied in the first direction, for example a force applied as moment arm. A pad 364 may also be applied to the panel facing surface of the vertical flange 352. The pad may be thicker than the first pad. In this way, the pad provides an corner offset, or gap 370, allowing the hook assembly to be secured to an underlying structure, such as a wall panel 371, which may have a protuberance or edge 372 disposed in the gap 370.

A hook 380 is connected to the vertical flange and extends laterally from the second side of the vertical flange in a second direction opposite the first direction. In one embodiment, the hook includes a locater pin 382 that is received in an opening of the vertical flange. A fastener 384, such as a screw is inserted through the flange 352 and threadably engages the hook 380. The fastener 384 is offset, or spaced from, the locator pin 382, which prevents the hook from rotating. The hook may include an upturned lip portion 386, which defines a cavity 388 for receiving a strap 390, handle or other portion of an accessory such as a coat, bag or backpack.

In operation, the hook assembly may be releasably secured to a support structure, such as the wall panel 371, by magnetically engaging the top surface 373 of the structure with the magnet 360, with the pad 362 engaging the surface 373. The vertical flange, and the pad 364 in particular, engages a side surface 375 of the support structure. An accessory, including for example a strap 390, may be disposed on the hook, with the load of the accessory being transmitted from the horizontal flange 358 to the surface 373, and with the pad 362 and magnetic attraction resisting shear and providing a moment arm with a horizontal force carried by the vertical flange 352.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A panel assembly comprising:

a vertical panel comprising opposite front and rear surfaces, an upper portion and a bottom portion;

an overhang panel comprising opposite upper and lower surfaces, an inner portion and an outer portion, wherein the overhang panel extends upwardly and outwardly from the upper portion of the vertical panel; and a curved transition panel disposed between the upper portion of the vertical panel and the inner portion of the overhang panel, wherein the curved transition panel comprises a rear surface and a front concave surface disposed between the front surface of the vertical panel and the lower surface of the overhang panel, and wherein the outer portion of the overhang panel is laterally spaced from the vertical panel.

2. The panel assembly of claim 1 wherein the lower surface of the overhang panel defines a first planar portion and wherein the front surface of the vertical panel defines a second planar portion, wherein the first and second planar portions form an angle of between and including 30 degrees and 90 degrees.

3. The panel assembly of claim 1 wherein the curved transition panel comprises a first curved transition panel, wherein the vertical panel comprises a first vertical panel comprising opposite first and second sides and a second vertical panel comprising opposite first and second sides, wherein the second side of the first vertical panel is disposed adjacent the first side of the second vertical panel, and further comprising a second curved transition panel disposed between the second side of the first vertical panel and the first side of the second vertical panel, wherein the second curved transition panel has a forwardly facing concave surface, and wherein the first and second vertical panels form an angle of between and including 30 degrees and 90 degrees.

4. The panel assembly of claim 3 wherein the overhang panel comprises a first overhang panel extending upwardly and outwardly from the first vertical panel and a second overhang panel extending upwardly and outwardly from the second vertical panel.

5. The panel assembly of claim 4 wherein the first curved transition panel is disposed between the first vertical panel and the first overhang panel, and further comprising a third curved transition panel disposed between the second vertical panel and the second overhang panel, wherein the third curved transition panel has a forwardly facing concave surface, and a fourth curved transition panel disposed between the first and second overhang panels, wherein the fourth curved transition panel has a forwardly facing concave surface.

6. The panel assembly of claim 5 further comprising a corner transition panel disposed between the first, second, third and fourth curved transition panels wherein the corner transition panel has a forwardly facing concave surface.

7. The panel assembly of claim 1 wherein the fabric layer comprises a first fabric layer, and further comprising a second fabric layer disposed over at least the rear surface of the vertical panel, the upper surface of the overhang panel and the rear surface of the curved transition panel.

8. The panel assembly of claim 7 wherein the first and second fabric layers are joined along at least one edge.

9. The panel assembly of claim 8 wherein the first and second fabric layers are releasably joined along at least one other edge.

10. The panel assembly of claim 8 wherein the first and second fabric layers are joined along at least three edges to define a pillow-case configuration.

11. The panel assembly of claim 1 wherein at least one of the vertical, overhang and curved transition panels comprises an opening, and further comprising a stay engaged with an outer surface of the fabric layer, wherein the stay and a portion of the fabric layer are inserted through the opening.

12. The panel assembly of claim 11 wherein the at least one of the vertical, overhang and curved transition panels panel comprises a substrate comprising a front substrate surface defining in part a respective portion of the front surface of the vertical panel, the lower surface of the overhang panel and the front surface of the curved transition panel, and further comprising a mounting member coupled to the substrate and comprising a front mounting surface spaced forwardly and/or downwardly from the front substrate surface, wherein the opening is disposed on the mounting member and extend through the front mounting surface.

13. The panel assembly of claim 12 wherein the mounting member defines a cavity on a rear side of the mounting member, wherein the cavity communicates with the opening, and wherein the stay and the portion of the fabric layer are positioned in the cavity.

14. The panel assembly of claim 11 wherein the opening is shaped as a line segment.

15. The panel assembly of claim 14 wherein the line segment is linear.

16. The panel assembly of claim 14 wherein the opening comprises a plurality of line segments extending from a common vertex.

17. The panel assembly of claim 16 wherein the opening comprises three line segments extending from the common vertex.

18. The panel assembly of claim 17 wherein the three line segments are angularly spaced at 120 degree intervals.

19. The panel assembly of claim 11 wherein the opening comprises a mouth with a tapered entry surface extending around at least a portion of a periphery of the opening.

20. The panel assembly of claim 1 wherein at least the vertical panel and the overhang panel comprise a frame and one or more substrates connected to the frame.

21. The panel assembly of claim 1 wherein at least the overhang panel and the curved transition panel comprise a unitary substrate.

* * * * *